US009340999B2

(12) United States Patent
Romero

(10) Patent No.: US 9,340,999 B2
(45) Date of Patent: May 17, 2016

(54) MANUALLY DRIVEN ELECTRONIC DEADBOLT ASSEMBLY WITH FREE-SPINNING BEZEL

(75) Inventor: Oscar Romero, Lake Forest, CA (US)

(73) Assignee: Kwikset Corporation, Lake Forest, CA (US)

( * ) Notice: Subject to any disclaimer, the term of this patent is extended or adjusted under 35 U.S.C. 154(b) by 4 days.

(21) Appl. No.: 14/127,188

(22) PCT Filed: Jun. 19, 2012

(86) PCT No.: PCT/US2012/043102

§ 371 (c)(1),
(2), (4) Date: Dec. 29, 2013

(87) PCT Pub. No.: WO2012/177609

PCT Pub. Date: Dec. 27, 2012

(65) Prior Publication Data

US 2014/0109633 A1 Apr. 24, 2014

Related U.S. Application Data

(60) Provisional application No. 61/498,893, filed on Jun. 20, 2011.

(51) Int. Cl.
*E05B 47/06* (2006.01)
*E05B 47/00* (2006.01)

(52) U.S. Cl.
CPC ..... *E05B 47/06* (2013.01); *E05B 47/0684* (2013.01); *E05B 47/0012* (2013.01); *E05B 2047/0031* (2013.01); *Y10T 70/5336* (2015.04)

(58) Field of Classification Search
CPC . E05B 47/06; E05B 47/0684; E05B 47/0012; E05B 2047/0031; E05B 47/0688; E05B 47/0692; E05B 2047/0028; E05B 47/0676; Y10T 70/5336
USPC ..... 70/189–191, 218, 222, 223, 386, 277, 70/278.1, 279.1, 422, 472, 149, 278.7
See application file for complete search history.

(56) References Cited

U.S. PATENT DOCUMENTS 4,148,092 A 4/1979 Martin
6,116,066 A * 9/2000 Gartner et al.

(Continued)

OTHER PUBLICATIONS

Schlage Installation Instructions. Manual (online). Schlage Lock Company. Mar. 23, 2009. (retrieved on Aug. 15, 2012). Retrieved from the internet:<URL: http://consumer.schlage.com/Project%20Documents/P515-858.pdf>.

(Continued)

*Primary Examiner* — Lloyd Gall
*Assistant Examiner* — Amanda L Miller
(74) *Attorney, Agent, or Firm* — Barnes & Thornburg LLP

(57) ABSTRACT

A manually driven electronic deadbolt assembly configured with an electro¬ mechanical coupling mechanism to selectively couple a manually operable bezel to a torque blade for operation of a deadbolt mechanism. The electro-mechanical coupling mechanism is configured such that in a locked condition the manually operable bezel is drivably decoupled from the torque blade, such that the manually operable bezel is free-spinning when rotated so as to be rendered incapable of rotating the torque blade to operate the deadbolt mechanism. Also, the electro-mechanical coupling mechanism is configured to drivably couple the manually operable bezel to the torque blade when a valid code is input to a code input mechanism to facilitate the unlocked condition, such that a rotation of the manually operable bezel effects a rotation of the torque blade to operate the deadbolt mechanism.

31 Claims, 27 Drawing Sheets

(56) References Cited

U.S. PATENT DOCUMENTS

| | | | | |
|---|---|---|---|---|
| 6,598,909 | B2 * | 7/2003 | Lu | 292/144 |
| 7,096,697 | B2 * | 8/2006 | Keightly | 70/279.1 |
| 7,188,495 | B2 | 3/2007 | Errani et al. | |
| D631,323 | S | 1/2011 | Stevens et al. | |
| 8,141,400 | B2 | 3/2012 | Sorensen et al. | |
| 8,490,444 | B2 * | 7/2013 | Saari et al. | 70/277 |
| 2009/0193859 | A1 * | 8/2009 | Kwon et al. | 70/91 |
| 2010/0263419 | A1 * | 10/2010 | Calleberg | 70/277 |
| 2010/0294008 | A1 * | 11/2010 | Bogdanov et al. | 70/277 |
| 2012/0198897 | A1 * | 8/2012 | Lui | 70/280 |

OTHER PUBLICATIONS

Search Report and Written Opinion issued in Int'l App. No. PCT/US2012/043102 (2012).

* cited by examiner

MANUALLY DRIVEN ELECTRONIC DEADBOLT ASSEMBLY WITH FREE-SPINNING BEZEL

This patent application is a U.S. Nationalization of international patent application no. PCT/US2012/043102, filed Jun. 19, 2012, which claims priority under 35 U.S.C. §119(e) to U.S. Provisional Patent Application No. 61/498,893, filed Jun. 20, 2011. The disclosures set forth in the referenced applications are incorporated herein by reference in their entireties

BACKGROUND OF THE INVENTION

1. Technical Field

The present invention relates to door lock devices, and more particularly, to a manually driven electronic deadbolt assembly having a free-spinning bezel.

2. Background Art

A keyed deadbolt assembly is used to supplement the level of security provided by a simple keyed lock configured integral with a doorknob. A traditional deadbolt assembly includes an exterior keyed lock cylinder and a cylinder body that projects away from the surface of a standard door. The lock cylinder has a tail piece that is operably connected to a deadbolt actuation mechanism to facilitate retraction and extension of the deadbolt. An interior turn piece is provided on the interior side of the door, and also is operably connected to the deadbolt actuation mechanism.

Some attempts have been made to provide an electronic door latch, which may utilize motorized retraction of the latch bolt. Also, such electronic door latches may require door modification to accommodate the electronic door latch.

DISCLOSURE OF INVENTION

The present invention provides a manually driven electronic deadbolt assembly having a free-spinning exterior manually operable bezel and an associated method of operating a deadbolt mechanism.

The invention, in one form thereof, is directed to a manually driven electronic deadbolt assembly for use on a door separating an exterior space from a secured space. The manually driven electronic deadbolt assembly includes a deadbolt mechanism, a torque blade, an interior actuator assembly, and an exterior actuator assembly. The deadbolt mechanism has a spindle drive opening, and the torque blade is configured to be drivably received in the spindle drive opening of the deadbolt mechanism. The torque blade has a first end and a second end. The interior actuator assembly is configured to operate the deadbolt mechanism from the secured space, and is mechanically connected to the first end of the torque blade. The exterior actuator assembly is configured to operate the deadbolt mechanism from the exterior space.

The exterior actuator assembly has a locked condition and an unlocked condition. The exterior actuator assembly has a chassis body, a manually operable bezel, a code input mechanism, a control circuit, and an electro-mechanical coupling mechanism. The chassis body is configured to mount the exterior actuator assembly to the door. The manually operable bezel is rotatably coupled to the chassis body and is configured to selectively operate the deadbolt mechanism. The code input mechanism is coupled to the chassis body, with the code input mechanism being configured to receive an input code from a user. A control circuit is coupled in electrical communication with the code input mechanism. The control circuit is configured with control logic to discriminate between a valid input code and an invalid input code. The electro-mechanical coupling mechanism is mounted to the chassis body, and is configured to selectively couple the manually operable bezel to the torque blade. The electro-mechanical coupling mechanism is communicatively coupled to the control circuit and is mechanically connected to the second end of the torque blade. The electro-mechanical coupling mechanism is configured such that in the locked condition the manually operable bezel is drivably decoupled from the torque blade in which the manually operable bezel is free-spinning when rotated and incapable of rotating the torque blade to operate the deadbolt mechanism. Also, the electro-mechanical coupling mechanism is configured to drivably couple the manually operable bezel to the torque blade when the valid input code is input to the code input mechanism to facilitate the unlocked condition in which a rotation of the manually operable bezel effects a rotation of the torque blade to operate the deadbolt mechanism.

Advantageously, the manually driven electronic deadbolt assembly of the present invention may be incorporated as a direct replacement for a traditional keyed deadbolt assembly.

Also, the exterior manually operable bezel of the present invention is free-spinning when the manually driven electronic deadbolt assembly is in the locked condition, thus adding an additional level of security to the manually driven electronic deadbolt assembly.

BRIEF DESCRIPTION OF DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

MODE(S) FOR CARRYING OUT THE INVENTION

Figure 1:
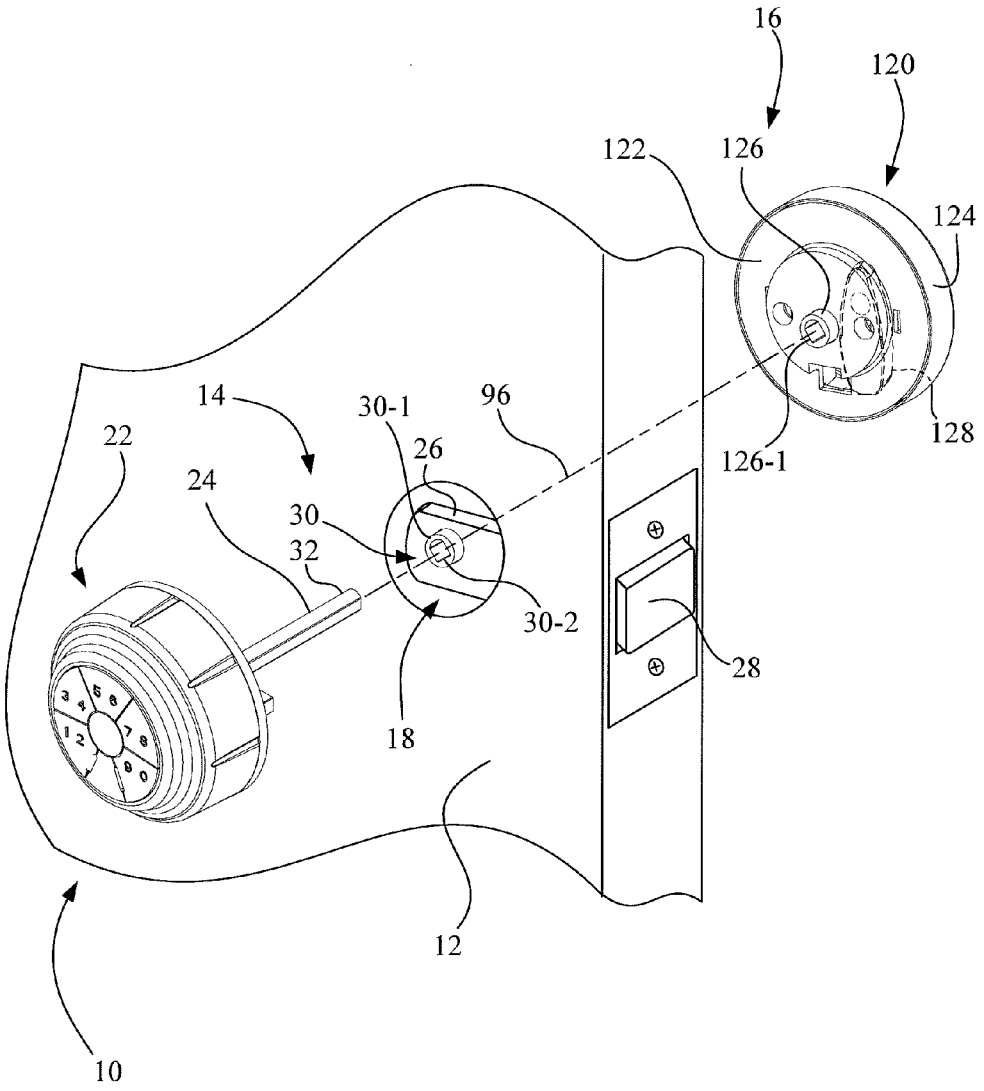
FIG. 1 is an exploded view of a manually driven electronic deadbolt assembly in accordance with the embodiments of the present invention for use on a door that separates an exterior space from a secured space.

Referring now to the drawings, and more particularly to FIG. 1, there is shown a manually driven electronic deadbolt assembly 10 in accordance with the embodiments of the present invention for use on a door 12 separating an exterior space 14 from a secured space 16. Manually driven electronic deadbolt assembly 10 includes a deadbolt mechanism 18, an interior actuator assembly 120, an exterior actuator assembly 22, and a torque blade 24. The term "deadbolt" as used herein is intended to include both the traditional deadbolt having a substantially blunt distal end, as well as the structure commonly referred to as a "latch bolt" having a beveled or rounded distal end.

Deadbolt mechanism 18 includes a housing 26 that carries a retractable deadbolt 28, and is configured as is well known in the art. Deadbolt mechanism 18 includes a deadbolt drive mechanism 30 having a spindle drive 30-1 that has a spindle drive opening 30-2. Spindle drive opening 30-2 is non-circular, e.g., having a square or D-shaped cross-section, so as to receive a rotational driving force from torque blade 24.

Torque blade 24 extends between interior actuator assembly 120 and exterior actuator assembly 22, and is slidably received through spindle drive opening 30-2 of deadbolt drive mechanism 30. Torque blade 24 has a first end 32 that is received by a portion of interior actuator assembly 120 and has a second end 34 that is received by a portion of exterior actuator assembly 22.

Torque blade 24 is configured to drive deadbolt drive mechanism 30 of deadbolt mechanism 18 by a rotation of torque blade 24. Thus, torque blade 24 is configured to be drivably received in spindle drive opening 30-2 of deadbolt mechanism 18, and in this regard torque blade 24 has a cross-section shape, e.g., square or D-shaped, that corresponds to the shape of spindle drive opening 30 so as to convey a rotational force to deadbolt drive mechanism 30 of deadbolt mechanism 18.

Figure 2:
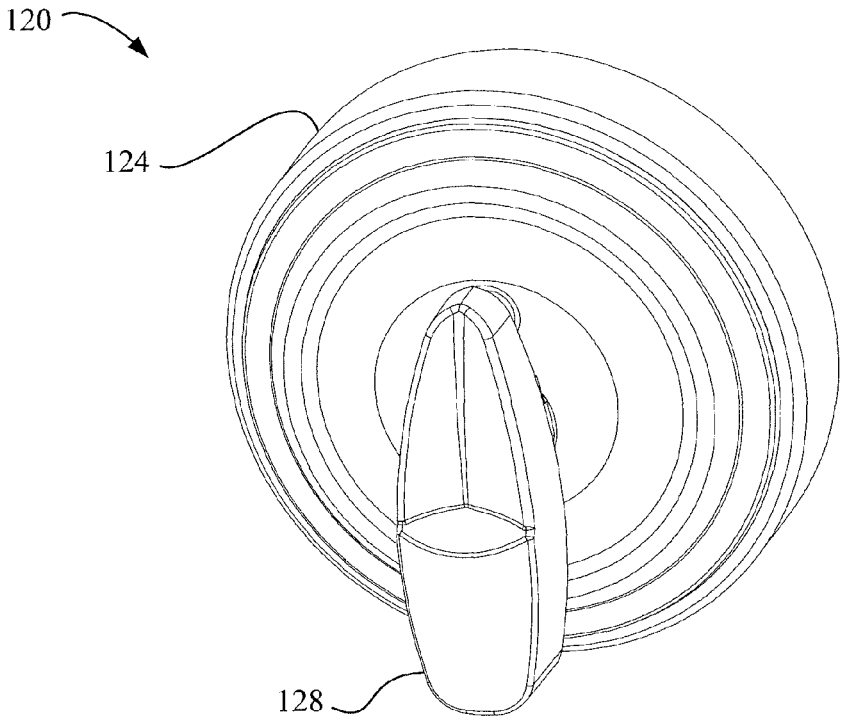
FIG. 2 is a front perspective view of an interior actuator assembly of the manually driven electronic deadbolt assembly of FIG. 1.
Figure 3:
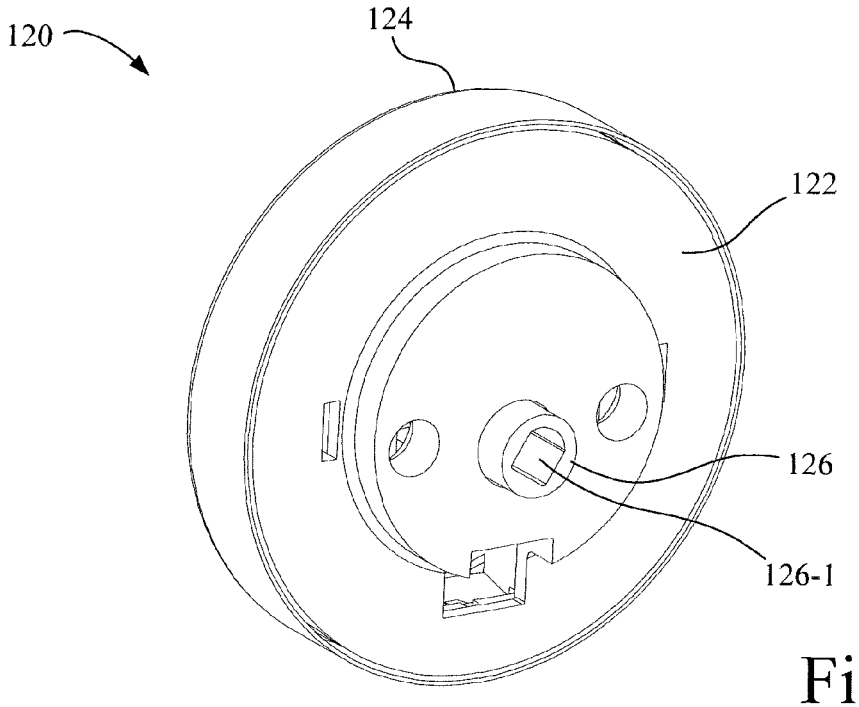
FIG. 3 is a rear perspective view of the interior actuator assembly of the manually driven electronic deadbolt assembly of FIG. 1.

Referring also to FIGS. 2 and 3, interior actuator assembly 120 includes a base 122; an interior cover 124, also referred to as interior rose 124; and an interior torque blade driver 126 has a shaped opening 126-1 for drivably receiving first end 32 of torque blade 24. An interior turn piece 128 is rotatably mounted to interior cover 124.

Base 122 is configured to mount interior actuator assembly 120 to door 12. Interior actuator assembly 120 is configured to operate deadbolt mechanism 18 from the secured space 16 via interior turn piece 128. More particularly, interior actuator assembly 120 is configured in a fail-safe manner to provide a continuous drive via interior turn piece 128 through torque blade 24 to selectively retract and extend retractable deadbolt 28 of deadbolt mechanism 18 by a rotation of interior turn piece 128. In other words, interior turn piece 128 is always drivably connected to deadbolt mechanism 18 to operate retractable deadbolt 18.

Figure 4:
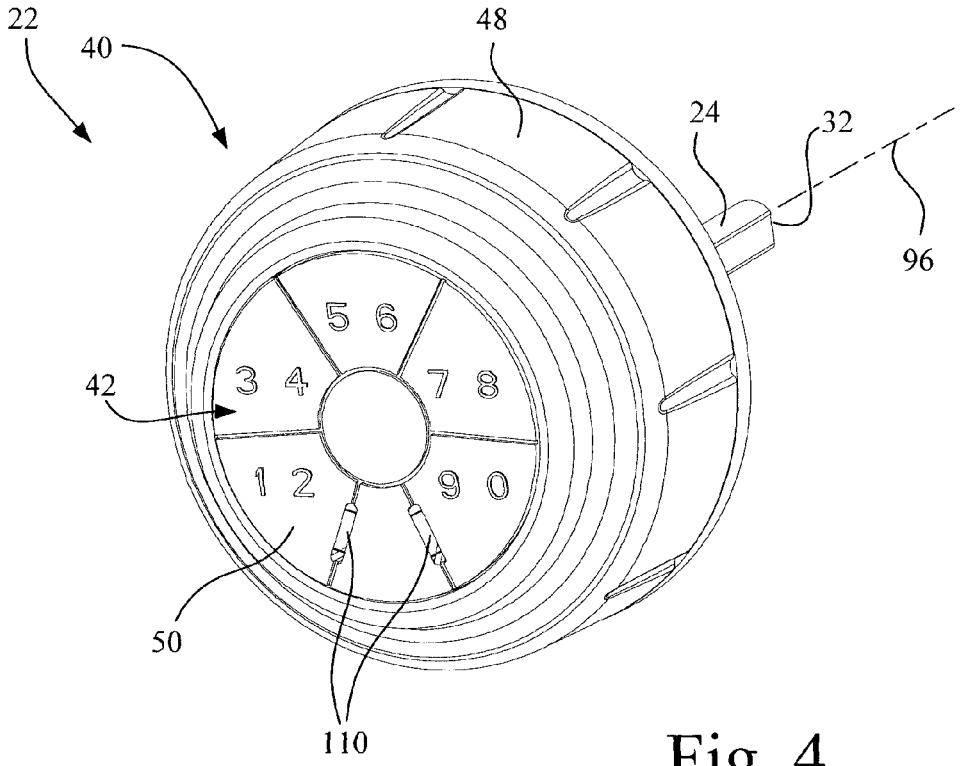
FIG. 4 is a front perspective view of an exterior actuator assembly of the manually driven electronic deadbolt assembly of FIG. 1.
Figure 5:
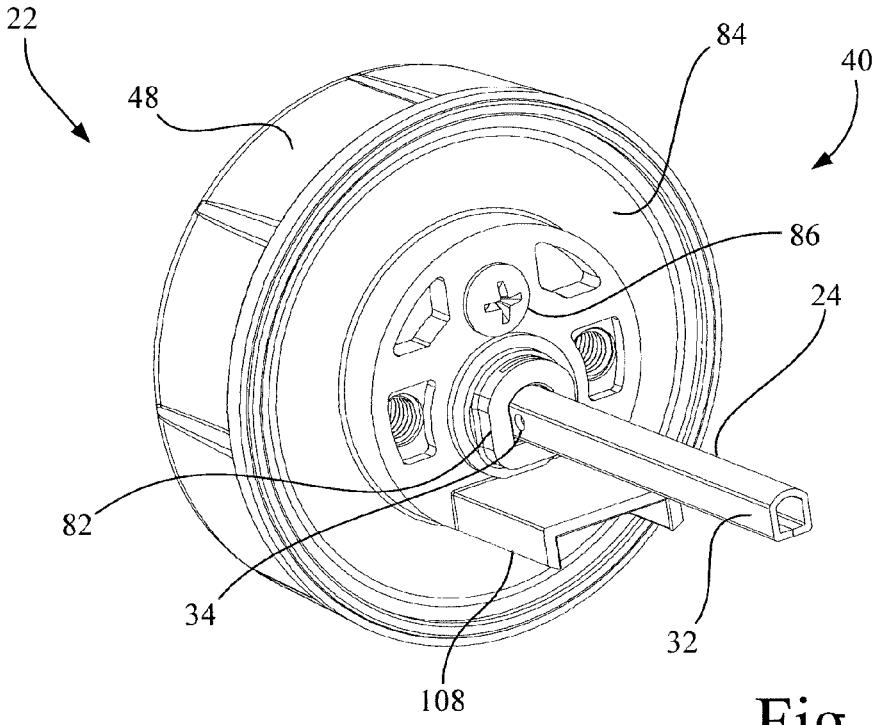
FIG. 5 is a rear perspective view of the exterior actuator assembly of the manually driven electronic deadbolt assembly of FIG. 1.
Figure 6:
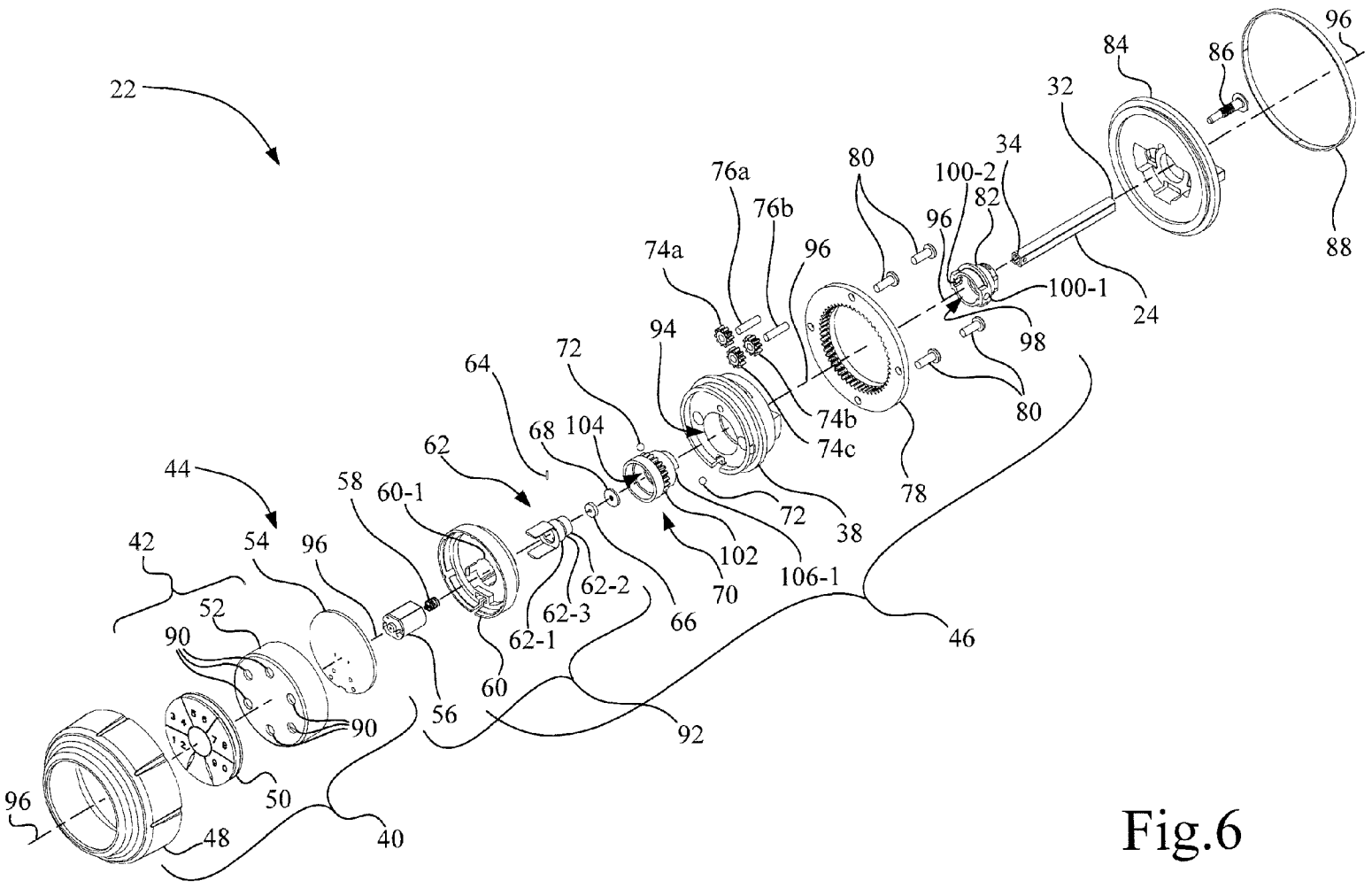
FIG. 6 is an exploded view of the exterior actuator assembly of the manually driven electronic deadbolt assembly of FIGS. 4 and 5.

Referring also to FIGS. 4-6, exterior actuator assembly 22 is configured to selectively operate deadbolt mechanism 18 from the exterior space 14. The exterior actuator assembly 22 has a locked condition and an unlocked condition. In the locked condition, operation of deadbolt mechanism 18 is prohibited by drivably decoupling exterior actuator assembly 22 from deadbolt mechanism 18. In the unlocked condition, operation of deadbolt mechanism 18 is permitted by drivably coupling exterior actuator assembly 22 to deadbolt mechanism 18.

Referring to FIGS. 4-11, exterior actuator assembly 22 includes a chassis body 38, a manually operable bezel assembly 40, a code input mechanism 42, a control circuit 44, and an electro-mechanical coupling mechanism 46. More particularly, as best shown in FIG. 6, exterior actuator assembly 22 includes a manually operable bezel 48, segmented touch pad 50, a button cover 52, a printed circuit board 54, a motor 56, drive spring 58, a body plate 60, a shifter 62, pin 64, a magnet 66, washer 68, gear sleeve 70, coupling members 72, idler gear 74*a*, idler gear 74*b*, drive gear 74*c*, idler shaft 76*a*, idler shaft 76*b*, a gear driver 78, bezel screws 80, torque blade driver 82, a back cover 84, gear axle screw 86, and a base ring 88.

Chassis body 38 is a non-rotatable chassis that is used to mount exterior actuator assembly 22 to an exterior of door 12.

Manually operable bezel 48, which may be a component of manually operable bezel assembly 40, is rotatably coupled to chassis body 38 and is configured to selectively operate deadbolt mechanism 18.

Code input mechanism 42, which may include segmented touch pad 50, is coupled to chassis body 38, and is configured to receive an input code from a user. For example, segmented touch pad 50 has six input pad segments which correspond to the six input buttons 90 arranged in a circular pattern on button cover 52, which in turn provide input signals to printed circuit board 54 of control circuit 44.

Control circuit 44 may be configured, for example, as a programmable microprocessor unit having associated memory and input/output components. Control circuit 44 is coupled in electrical communication with code input mechanism 42. Control circuit 44 is configured with control logic to discriminate between a valid input code and an invalid input code entered by a user via code input mechanism 42. Such discrimination may be performed, for example, by comparison logic in control circuit 44 that compares the current input code entered by a user to a set of valid input codes that may be stored in a lookup table in electronic memory (RAM, ROM EPROM, EEPROM, etc) of control circuit 44.

If, for example, the manually driven electronic deadbolt assembly 10 is locked and a valid input code is entered by a user, the exterior actuator assembly 22 will attain the unlocked condition and the user will have a predetermined period of time in which to rotate manually operable bezel 48 to operate deadbolt mechanism 18 to retract retractable deadbolt 28. If deadbolt mechanism 18 has not been unlocked by retracting retractable deadbolt 28 (detectable by a switch or sensor communicatively coupled to control circuit 44) within the predetermined time period, control circuit 44 will cause exterior actuator assembly 22 to revert to the locked condition.

However, when manually driven electronic deadbolt assembly 10 is unlocked, by operation of either of operation exterior actuator assembly 22 or interior actuator assembly 120, manually driven electronic deadbolt assembly 10 will remain unlocked until manually locked by a user by operation of either of manually operable bezel 48 of exterior actuator assembly 22 or interior turn piece 128 of interior actuator assembly 120.

Electro-mechanical coupling mechanism 46 is mounted to chassis body 38, and is configured to selectively couple manually operable bezel 48 to torque blade 24. Electro-mechanical coupling mechanism 46 is communicatively coupled to control circuit 44 via an electrical connection and is mechanically connected to second end 34 of torque blade 24.

The electro-mechanical coupling mechanism 46 of exterior actuator assembly 22 is configured such that in the locked condition the manually operable bezel 48 is drivably decoupled from torque blade 24, such that the manually operable bezel 48 is free-spinning when rotated so as to be rendered incapable of rotating torque blade 24 to operate deadbolt mechanism 18.

Also, electro-mechanical coupling mechanism 46 is configured to drivably couple the manually operable bezel 48 to torque blade 24 when a valid code is input to code input mechanism 42 to facilitate the unlocked condition, such that a rotation of the manually operable bezel 48 effects a rotation of torque blade 24 to operate deadbolt mechanism 18 to selectively extend or retract the retractable deadbolt 28.

Referring again to FIG. 6, electro-mechanical coupling mechanism 46 includes gear sleeve 70; coupling member, e.g., ball bearing, 72; at least one intermediate gear 74, e.g., gears 74*a*, 74*b*, 74*c*; torque blade driver 82; and an actuator mechanism 92. Actuator mechanism 92 includes motor 56, shifter 62, and a rotational-to-linear translator mechanism that in the present embodiment is formed by drive spring 58 and pin 64. Body plate 60 includes an opening 60-1 for mounting motor 56.

Figure 7:
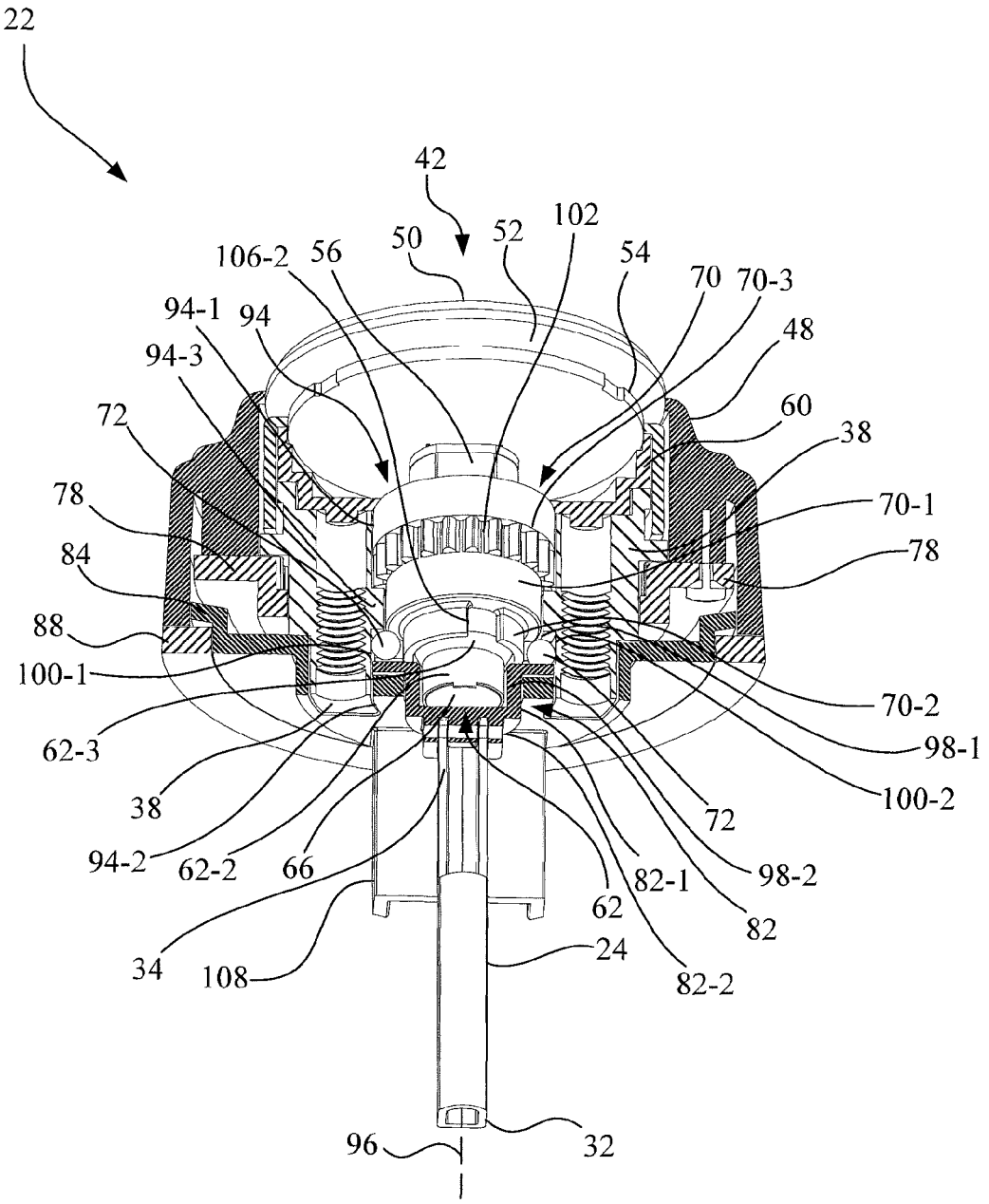
FIG. 7 is a sectional view of the exterior actuator assembly of FIGS. 4 and 5 with components positioned in the locked position.

Referring to FIGS. 6 and 7, chassis body 38 includes an opening 94 defining a rotational axis 96. Opening 94 is configured with a first axial bore 94-1 for receiving gear sleeve 70 to facilitate rotation of gear sleeve 70 about rotational axis 96, and opening 94 has a second axial bore 94-2 for receiving torque blade driver 82 to facilitate selectable rotation about rotational axis 96. Separating first axial bore 94-1 from second axial bore 94-2 is a shoulder 94-3.

Torque blade driver 82 has a driver body 82-1 having a driver end 82-2 configured to drivably engage second end 34 of torque blade 24. Driver body 82-1 has a proximal cavity 98 defined by a first proximal bore 98-1 and a second proximal bore 98-2. Driver body 82-1 of torque blade driver 82 further includes at least one recess 100, which in the present embodiment includes recess 100-1 and recess 100-2 arranged to be diametrically opposed. Each of recess 100-1 and recess 100-2 extends radially outwardly from proximal cavity 98 into driver body 82-1 of torque blade driver 82, and in the present embodiment extends extend radially outwardly from first proximal bore 98-1 through driver body 82-1.

Torque blade driver 82 is drivably engaged with torque blade 24, and torque blade 24 is configured for driving engagement with latch deadbolt mechanism 18. Torque blade driver 82 is axially retained in second axial bore 94-2 of chassis body 38 by back cover 84. Each of recess 100-1 and recess 100-2 of torque blade driver 82 forms a nest for permanently carrying coupling members, e.g., ball bearings, 72, with the nests being configured to facilitate movement of ball bearings 72 in a radial direction relative to rotational axis 96 while torque blade driver 82 is radially restrained by chassis body 38.

Gear sleeve 70 is configured to be rotatable around rotational axis 96. Gear sleeve 70 has a sleeve body 70-1 with a distal sleeve portion 70-2 configured to be rotatably received in proximal cavity 98 of torque blade driver 82. Sleeve body 70-1 of gear sleeve 70 has a proximal sleeve portion 70-3 with a circumferential gear 102 having external gear teeth extending outwardly from sleeve body 70-1. Sleeve body 70-1 has an internal cavity 104. Sleeve body 70-1 has at least one recess 106 located in distal sleeve portion 70-2, which in the present embodiment includes recess 106-1 and recess 106-2 arranged to be diametrically opposed. Each of recess 106-1 and recess 106-2 extends radially inwardly from an exterior surface of distal sleeve portion 70-2 toward internal cavity 104, and through sleeve body 70-1.

Each of recess 106-1 and recess 106-2 of gear sleeve 70 forms a nest which selectively receives a coupling member, e.g., ball bearing, 72 in a radial direction relative to rotational axis 96. The nests of gear sleeve 70 permit radial movement of ball bearings 72 while gear sleeve 70 is radially restrained by chassis body 38.

When ball bearings 72 are at least one-half received (as measured by the ball bearing diameter) in recess 106-1 and recess 106-2 (nests) of gear sleeve 70, ball bearings 72 rotatably fix gear sleeve 70 to torque blade driver 82, such that gear sleeve 70 and torque blade driver 82 rotate in unison. When ball bearings 72 are less than one-half received (as measured by the ball bearing diameter) in recess 106-1 and recess 106-2 (nests) of gear sleeve 70, ball bearings 72 do not rotatably fix gear sleeve 70 to torque blade driver 82.

Actuator mechanism 92 is configured to selectively position the coupling members, e.g., ball bearings, 72 relative to the recesses 100-1, 100-2 of torque blade driver 82 and recesses 106-1, 106-2 of gear sleeve 70 to selectively select the locked condition and the unlocked condition. In the present embodiment the ball bearings made of ferromagnetic material, and the positioning of ball bearings 72 is dependent on the axial position of shifter 62 and magnet 66.

Shifter 62 has a proximal portion 62-1 having a first diameter and a distal portion 62-2 having a second diameter less than the first diameter. An annular bevel 62-3 of shifter 62 transitions between proximal portion 62-1 and distal portion 62-2.

The internal cavity 104 of gear sleeve 70 is formed as a longitudinal bore. The proximal portion 62-1 of shifter 62 is axially slidably received in the longitudinal bore of internal cavity 104 of gear sleeve 70. Magnet 66 is mounted to an end portion, i.e., at distal portion 62-2, of shifter 62. Shifter 62 has an axial bore defining an inner circumferential portion of shifter 62, and pin 64 radially projects inwardly from the inner circumferential portion of shifter 62 toward rotational axis 96.

Drive spring 58 is mounted to the rotatable shaft of motor 56 for rotation therewith. A distal portion of pin 64 is drivably received between the coils of drive spring 58, such that rotation of drive spring 58 by motor 56 in a first rotational direction results in an axial displacement of shifter 62 in a first longitudinal direction, and rotation of drive spring 58 in a second rotational direction opposite the first rotational direction results in an axial displacement of shifter 62 in a second longitudinal direction opposite the first longitudinal direction.

In the present embodiment, manually operable bezel 48, segmented touch pad 50, button cover 52, printed circuit board 54 and gear driver 78 form a freely rotatable bezel unit, the manually operable bezel assembly 40, which is rotatable relative to chassis body 38. Gear driver 78 is drivably coupled to gear sleeve 70, which may be an indirect coupling via at least one intermediate gear (FIG. 9) or may be by a direct coupling (FIG. 9A).

Figure 9:
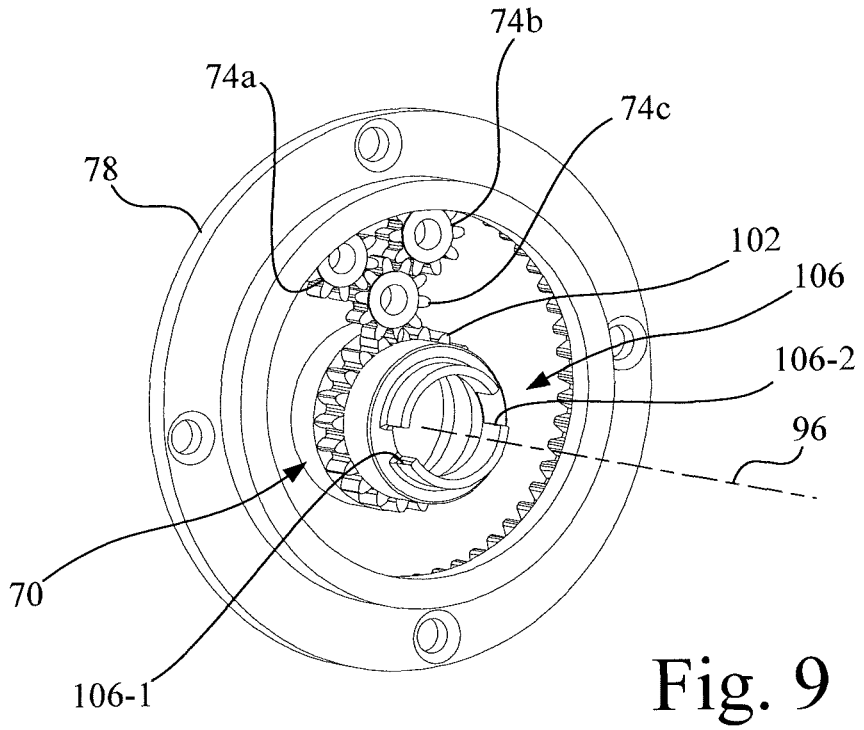
FIG. 9 is a perspective view of a gearing arrangement of the exterior actuator assembly of FIGS. 4 and 5.
Figure 9A:
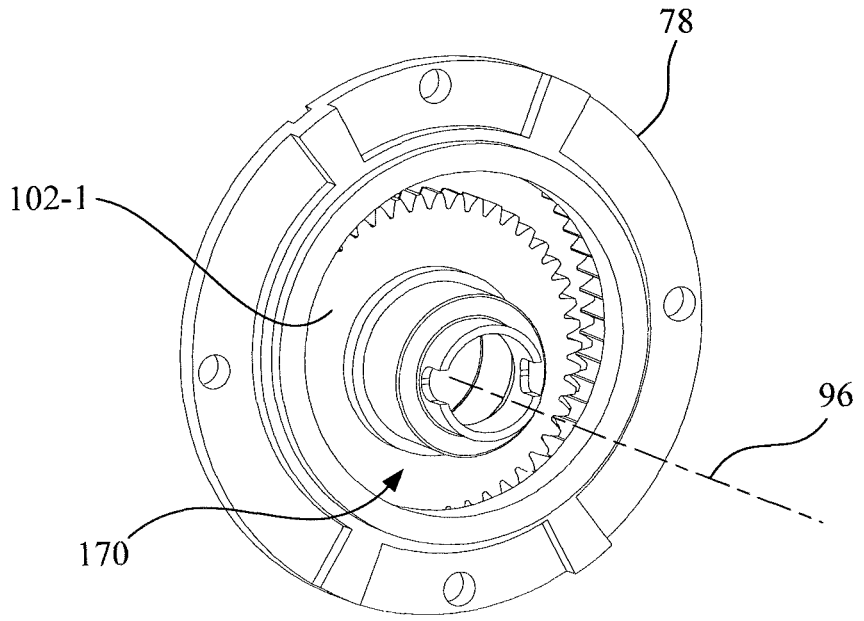
FIG. 9A is a gearing arrangement as an alternative to that of FIG. 9.

In the configuration depicted in FIG. 9, gear driver 78 has internal teeth which engage at least one intermediate gear (e.g., in the present embodiment the combination of gears 74*a*, 74*b*, 74*c*) and thus is rotatably coupled to circumferential gear 102 of gear sleeve 70. In the configuration depicted in FIG. 9A, gear driver 78 has internal teeth which directly engage the teeth of a modified (diametrically enlarged) circumferential gear 102-1 of a modified gear sleeve 170 and thus gear driver 78 is directly rotatably coupled to circumferential gear 102-1 of gear sleeve 170. In all other functional respects, gear sleeve 170 is the same as gear sleeve 70, and thus is considered as a direct replacement for gear sleeve 70 and the one or more intermediate gears.

Printed circuit board 54 is electrically connected to motor 56. Printed circuit board 54 of control circuit 44 includes memory, control logic, and an electrical actuator buttons corresponding to the various buttons 90 of button cover 52.

Bezel screws 80 fixedly mount gear driver 78 to manually operable bezel 48, with axially spaced flanges of chassis body 38 being interposed between body plate 60 and gear driver 78, such that manually operable bezel assembly 40 is rotatably mounted to chassis body 38. In the locked condition, the manually operable bezel assembly 40 is freely rotatable as a unit about rotational axis 96.

Figure 8:
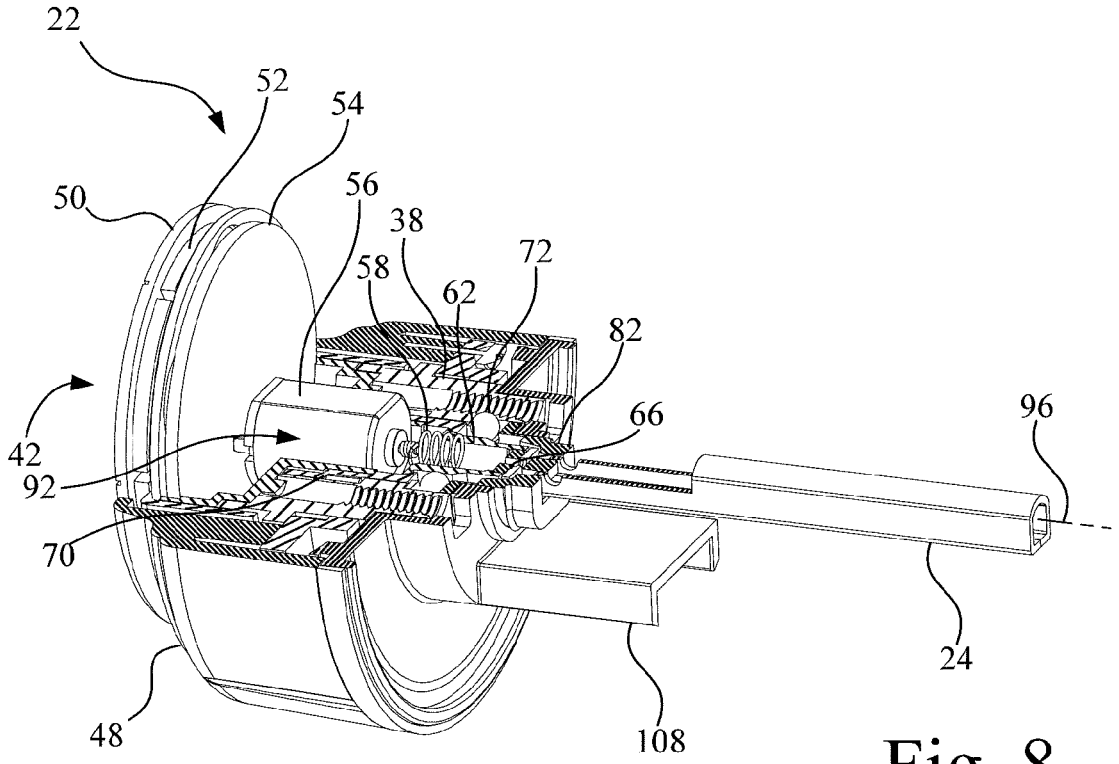
FIG. 8 is a side section view of the exterior actuator assembly of FIG. 7 with some components removed to expose the motor drive.

As shown for example in FIGS. 5, 7 and 8, back cover 84 includes an orientation tab 108 which designates the orientation of exterior actuator assembly 22 relative to door 12.

Referring also to FIG. 9, one or more intermediate gears, i.e., idler gears 74*a*, 74*b* and drive gear 74*c*, in combination with the gearing of gear driver 78 and the gearing of gear sleeve 70, form a gear train wherein manually operable bezel 48 is always rotationally coupled to gear sleeve 70. Idler gears 74*a*, 74*b* are mounted by respective idler shafts 76*a*, 76*b* (see FIG. 6). While two idler gears 74*a*, 74*b* are provided for robustness, those skilled in the art will recognize that one of idler gears 74*a*, 74*b* could be eliminated without affecting the operational functionality of exterior actuator assembly 22. Drive gear 74*c* is rotatably mounted by gear axle screw 86. Each of idler shafts 76*a*, 76*b* and gear axle screw 86 engages a respective hole in back cover 84. Thus, in the gear assembly described above, a manual rotation of manually operable bezel 48 will result in a rotation of gear sleeve 70.

Accordingly, in the present embodiment, manually operable bezel 48 always is drivably engaged with gear sleeve 70 via the rotatable gear driver 78, idler gear 74*a*, idler gear 74*b*, and drive gear 74*c*. However, gear sleeve 70 is selectively engageable with torque blade driver 82 via the coupling members, e.g., ball bearings, 72.

Shifter 62 is drivably engaged by drive spring 58 via pin 64 (see FIG. 6), with drive spring 58 being driven by motor 56. Thus, shifter 62 is configured for linear movement within internal cavity 104 of gear sleeve 70 along rotational axis 96 to move magnet 66 to define a locked position (shifter 62 distally extended, e.g., FIG. 10) corresponding to the locked condition and an unlocked position (shifter 62 proximally retracted, e.g., FIG. 11) corresponding to the unlocked condition.

The locked position (FIGS. 7 and 10) is when the shifter 62/magnet 66 is in the extended position such that proximal portion 62-1 (shoulder) of shifter 62 of the larger diameter can engage ball bearings 72, and the unlocked position (FIG. 11) is when the shifter 62/magnet 66 is in the retracted position such that distal portion 62-2 of shifter 62 of the smaller diameter can engage ball bearings 72.

Referring to FIG. 7, in the locked obstructed condition, the individual ball bearings 72 are positioned in a respectively nest (channel) formed by recesses 100-1, 100-2 in torque blade driver 82 adjacent gear sleeve 70, such that gear sleeve 70 cannot drive torque blade driver 82. As used herein, the term "obstructed" means that the recess(es) 100 of torque blade driver 82 is/are not radially aligned with the recess(es) 106 of gear sleeve 70. Also, as used herein, the term "unobstructed" means that the recess(es) 100 of torque blade driver 82 is/are radially aligned with the recess(es) 106 of gear sleeve 70.

Figure 10:
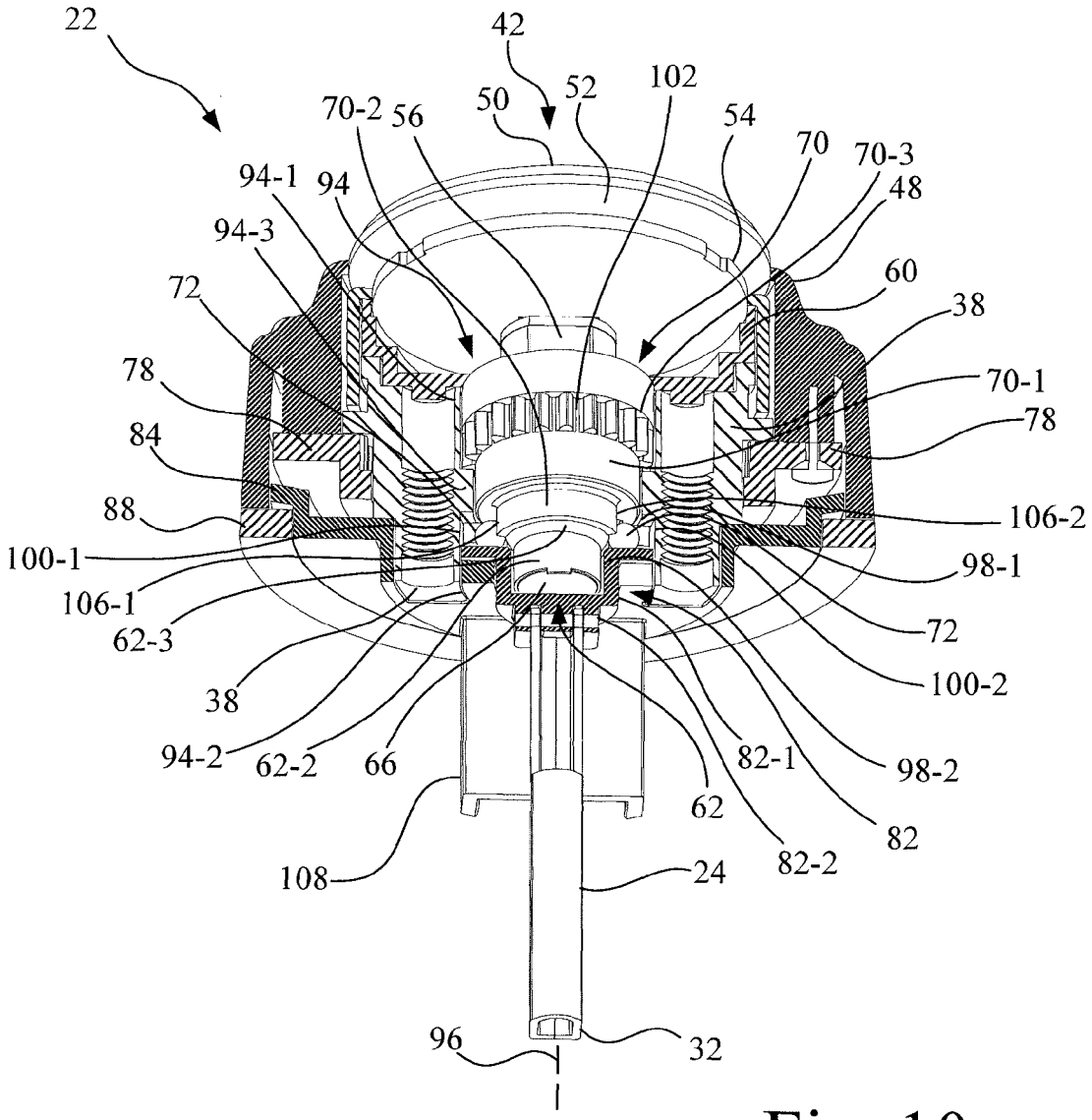
FIG. 10 is another sectional view of the exterior actuator assembly of FIGS. 4 and 5 with components in an alternate locked position with respect to FIG. 7.

Also, as shown in FIG. 10 in the locked unobstructed condition, with shifter 62 moved to the extended position, proximal portion 62-1 (shoulder) on shifter 62 forces the coupling members, e.g., ball bearings 72, outwardly, such that when recesses (nests) 106-1, 106-2 in gear sleeve 70 are aligned with ball bearings 72 in recesses 100-1, 100-2 of torque blade driver 82 and gear sleeve 70 is rotated by manually operable bezel 48, the side surface of the recesses (nests) 106-1, 106-2 of gear sleeve 70 strikes ball bearings 72 below the ball centerline from the perspective of gear sleeve 70, (or above the ball centerline from the perspective of torque blade driver 82), thus forcing the ball bearings 72 further outwardly into the recesses 100-1, 100-2 of torque blade driver 82, thus preventing a drivable coupling between gear sleeve 70 and torque blade driver 82.

Figure 11:
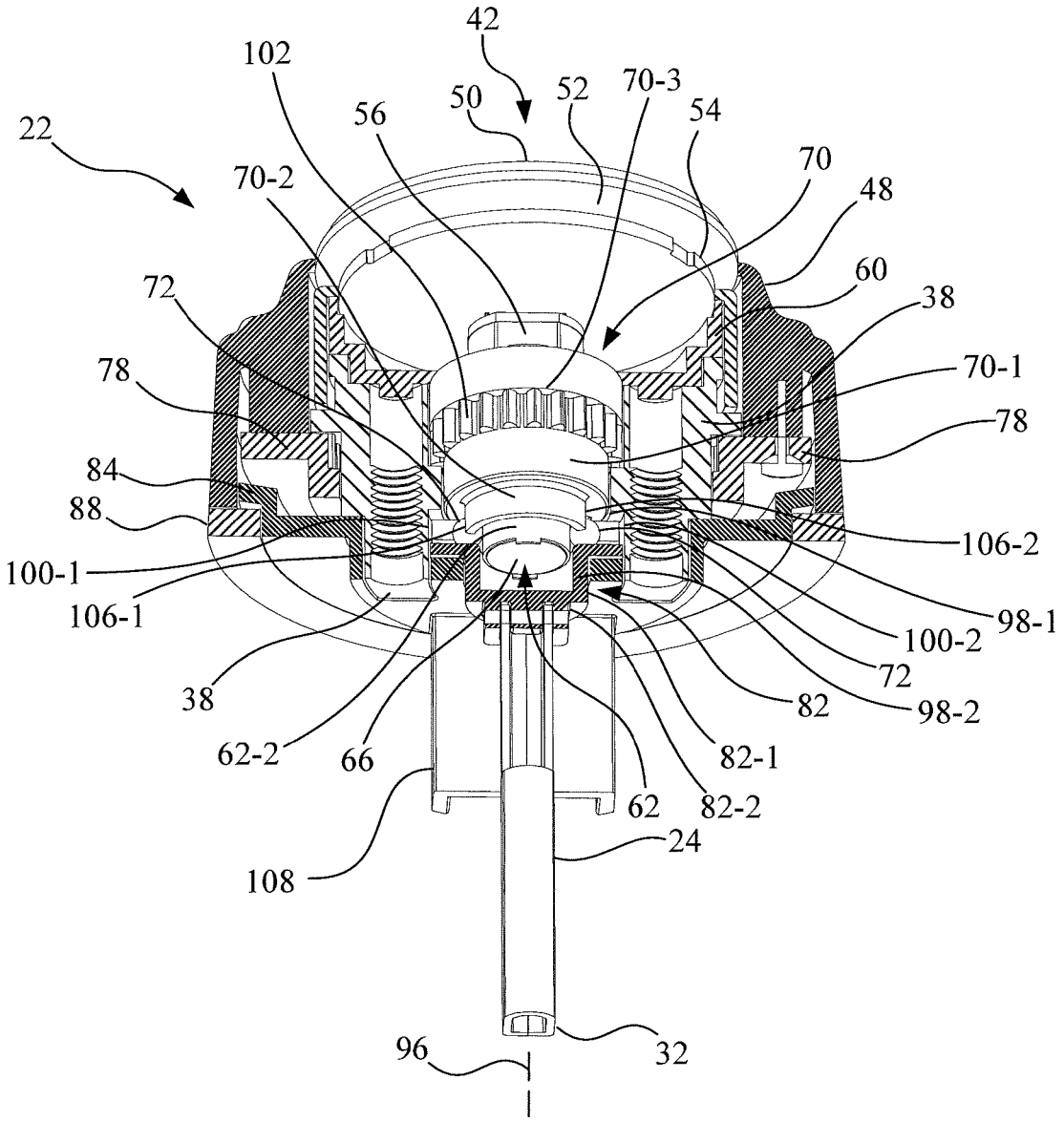
FIG. 11 is a sectional view of the exterior actuator assembly of FIGS. 4 and 5 with components positioned in the unlocked position.

Referring to FIG. 11, in the unlocked condition (shifter 62/magnet 66 retracted), ball bearings 72 are positioned in the recesses 100-1, 100-2 in torque blade driver 82, but proximal portion 62-1 (shoulder) of shifter 62 is no longer in a position to force the ball bearings 72 outwardly, such that when a respective recess (nest) 106-1, 106-2 in gear sleeve 70 is rotated into alignment with a respective ball bearing 72 in a respective recess 100-1 or recess 100-2 of torque blade driver 82, the ball bearing 72 is attracted by magnet 66 into the respective recess 106-1, 106-2 in gear sleeve 70 and into contact with the smallest diameter distal portion 62-2 of shifter 62. When gear sleeve 70 is further rotated by rotation of the manually operable bezel 48, gear sleeve 70 will strike the ball bearings 72 on or above the centerline of the ball bearings 72 from the perspective of gear sleeve 70, (or on or below the centerline of the ball bearings 72 from the perspective of torque blade driver 82), to maintain the ball in the attracted (inward) position toward rotational axis 96. As such, the ball bearings 72 couple gear sleeve 70 to torque blade driver 82 to permit operation of the deadbolt by rotation of the exterior manually operable bezel 48.

In operation, the user will enter a valid access code on the keypad of segmented touch pad 50 of code input mechanism 42 associated with the exterior manually operable bezel 48, which in turn will actuate motor 56 to position shifter 62 to the unlocked position to attain the unlocked condition, thus permitting the operation, e.g., unlocking, of deadbolt mechanism 18 by retraction of retractable deadbolt 28. When the valid access code is entered, the user has a period of time, e.g., 5 to 10 seconds, in which to rotate the exterior manually operable bezel 48 to retract (unlock) the retractable deadbolt 28 of deadbolt mechanism 18. After the period of time, motor 56 is driven by control circuit 44 to return shifter 62 back to the locked position to attain the locked condition.

In the present embodiment, motor 56 does not drive or in any way move the retractable deadbolt 28 of deadbolt mechanism 18. In the present embodiment, motor 56 is used to aid in coupling the manually operable bezel 48 to torque blade driver 82 via the shifter 62/magnet 66/ball bearing(s) 72/gear sleeve 70 arrangement. The magnet 66 provides selective biasing of the ball bearing(s) 72 towards rotational axis 96. Exterior actuator assembly 22 is configured such that rotational axis 96 is common to, for example, motor 56, drive spring 58, gear sleeve 70, gear driver 78, torque blade driver 82 and torque blade 24.

Referring again to FIG. 4, in the event of power failure to manually driven electronic deadbolt assembly 10, electrical contacts 110 are located to protrude outwardly from the face of segmented touch pad 50. Electrical contacts 110 are configured to facilitate application of electrical power to printed circuit board 54 of control circuit 44 for operation of exterior actuator assembly 22 in the event that the internal batteries become depleted. The spacing of electrical contacts 110 is such as to accommodate the terminals of a common 9 volt battery having positive and negative terminals at the same end of the battery.

FIGS. 12-18C illustrate an alternative embodiment of exterior actuator assembly 22, identified as exterior actuator assembly 200. Exterior actuator assembly 200 is configured to selectively operate deadbolt mechanism 18 from the exterior space 14 (see FIG. 1). The exterior actuator assembly 200 has a locked condition and an unlocked condition. In the locked condition, operation of deadbolt mechanism 18 is prohibited by drivably decoupling exterior actuator assembly 200 from deadbolt mechanism 18. In the unlocked condition, operation of deadbolt mechanism 18 is permitted by drivably coupling exterior actuator assembly 200 to deadbolt mechanism 18.

Exterior actuator assembly 200 is similar in design and function to that of exterior actuator assembly 22, and thus unless stated otherwise, the components and function of the components in exterior actuator assembly 200 will be presumed to be the same as that described above with respect to exterior actuator assembly 22, and thus for brevity such description will not be repeated in its entirety here.

Figure 12:
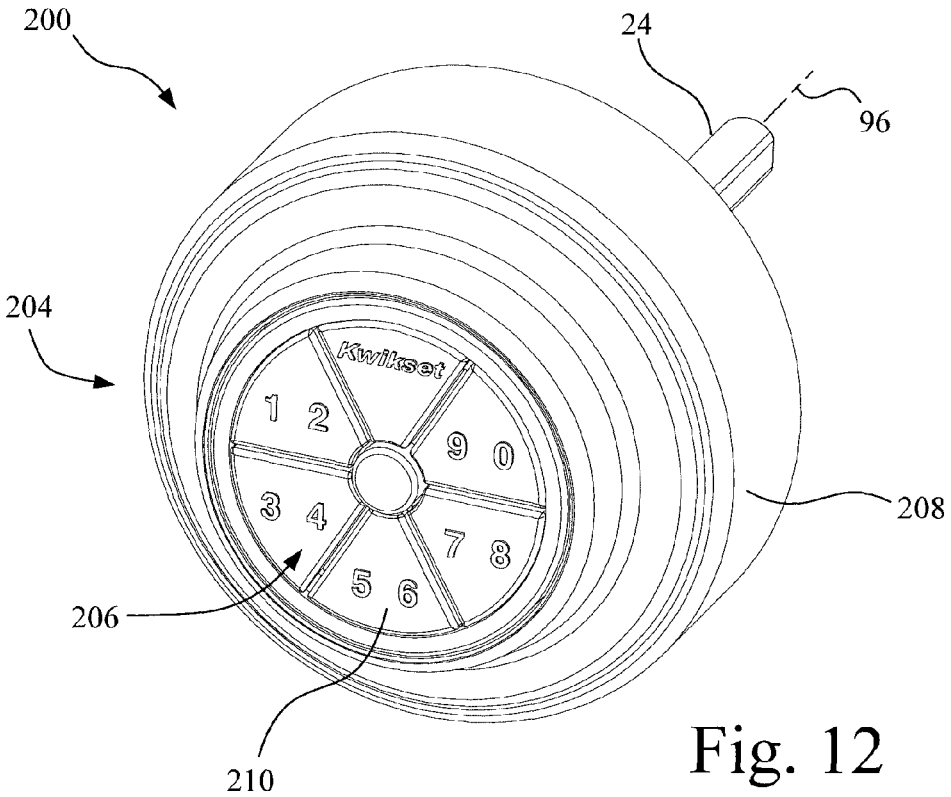
FIG. 12 is a front perspective view of an alternate embodiment of an exterior actuator assembly suitable for use with the manually driven electronic deadbolt assembly of FIG. 1.
Figure 13:
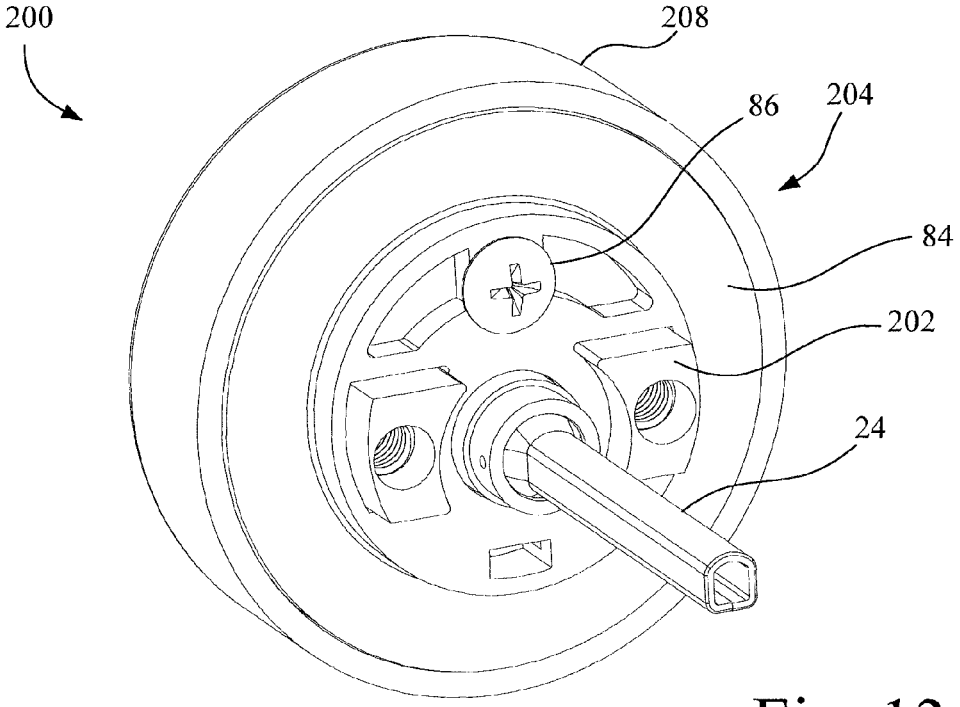
FIG. 13 is a rear perspective view of the exterior actuator assembly of FIG. 12.

Referring to FIGS. 12 and 13, exterior actuator assembly 200 includes a chassis body 202, a manually operable bezel assembly 204, and a code input mechanism 206. Chassis body 202 is a non-rotatable chassis that is used to mount exterior actuator assembly 200 to the exterior of door 12. Manually operable bezel assembly 204 includes a manually operable bezel 208 rotatably coupled to chassis body 202 and is configured to selectively operate deadbolt mechanism 18.

Code input mechanism 206, which may include segmented touch pad 210, is coupled to chassis body 202, and is configured to receive an input code from a user. For example, segmented touch pad 210 has six input pad segments which correspond to the six input buttons 90 arranged in a circular pattern on button cover 52 (see FIG. 2), which in turn provide input signals to printed circuit board 54 of control circuit 44 described above.

Referring also to FIGS. 14A-14D, exterior actuator assembly 200 includes an electro-mechanical coupling mechanism 212 mounted to chassis body 202, and is configured to selectively couple the manually operable bezel 208 to torque blade 24. Electro-mechanical coupling mechanism 212 is communicatively coupled to control circuit 44 and is mechanically connected to the second end 34 of torque blade 24.

The electro-mechanical coupling mechanism 212 of exterior actuator assembly 22 is configured such that in the locked condition the manually operable bezel 208 is drivably decoupled from torque blade 24, in which the manually operable bezel 208 is free-spinning when rotated so as to be rendered incapable of rotating torque blade 24 to operate deadbolt mechanism 18.

Also, electro-mechanical coupling mechanism 212 is configured to drivably couple the manually operable bezel 208 to torque blade 24 when a valid code is input to code input mechanism 206 to facilitate the unlocked condition, such that a rotation of the manually operable bezel 208 effects a rotation of torque blade 24 to operate deadbolt mechanism 18 to selectively extend or retract the retractable deadbolt 28 (see FIG. 1).

Electro-mechanical coupling mechanism 212 includes gear sleeve 70, a single coupling member, e.g., ferromagnetic (steel) ball bearing, 72, an intermediate gear 214, torque blade driver 82, and an actuator mechanism 216. Actuator mechanism 216 includes motor 56, a shifter 218, and a rotational-to-linear translator mechanism that in the present embodiment is formed by a threaded drive 220 (in the form of a worm gear or screw) and an internal axial threaded bore 222 of shifter 218. Threaded drive 220 is mounted to the rotatable shaft of motor 56 for rotation with the rotatable shaft. The external threads of threaded drive 220 threadably engage axial threaded bore 222 of shifter 218 to provide a linear translation of shifter 218.

Chassis body 202 includes an opening 94 defining a rotational axis 96. Opening 94 is configured with a first axial bore 94-1 for receiving gear sleeve 70 to facilitate rotation of gear sleeve 70 about rotational axis 96, and opening 94 has a second axial bore 94-2 for receiving torque blade driver 82 to facilitate selectable rotation about rotational axis 96.

Torque blade driver 82 is configured with driver body 82-1, driver end 82-2, and recess 100 as described above with respect to the previous embodiment. Torque blade driver 82 is axially retained in the second axial bore 94-2 of chassis body 202 by back cover 84. Recess 100 of torque blade driver 82 forms a nest for permanently carrying a coupling member, e.g., ball bearing, 72, with the nest being configured to facilitate movement of ball bearing 72 in a radial direction relative to rotational axis 96 while torque blade driver 82 is radially restrained by chassis body 202.

Figure 14A:
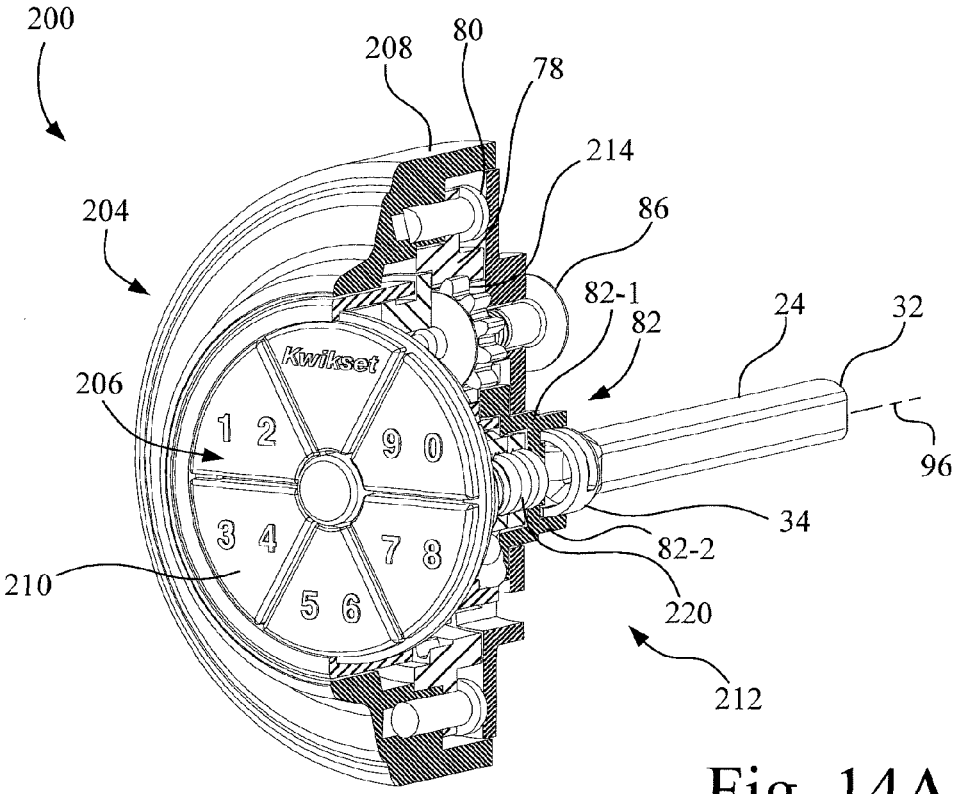
FIGS. 14A-14D show various partial section views of the exterior actuator assembly of FIGS. 12 and 13.
Figure 14B:
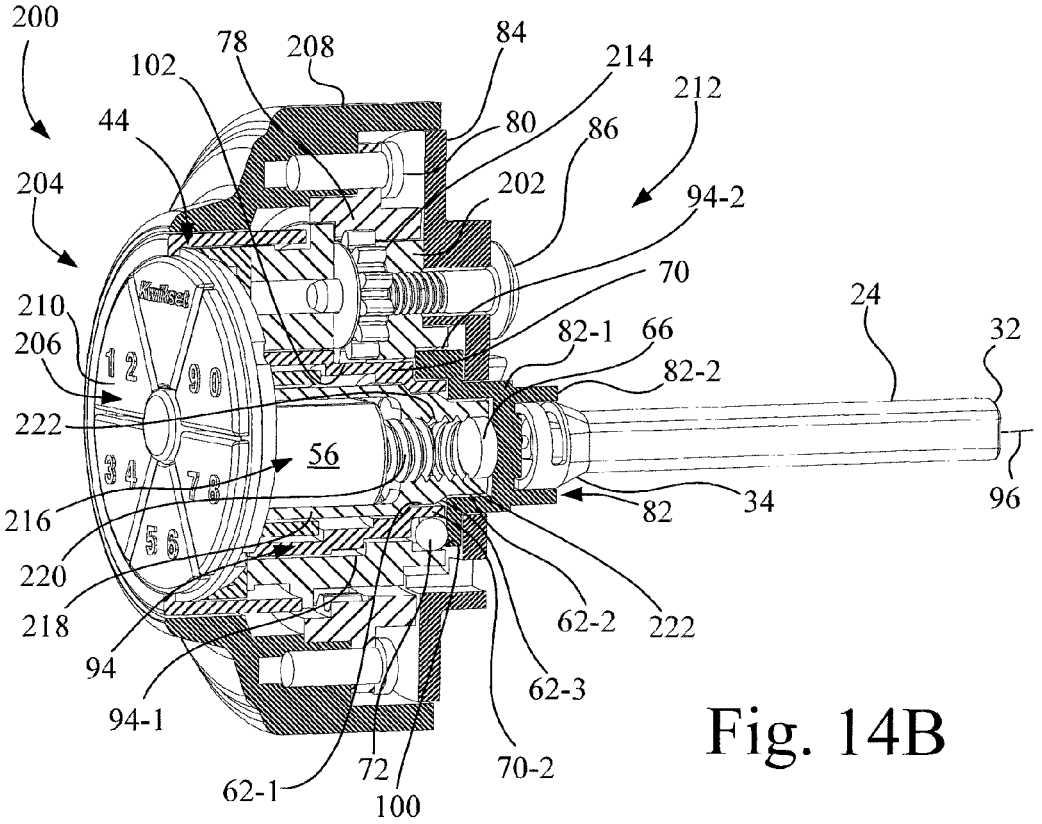
Figure 14C:
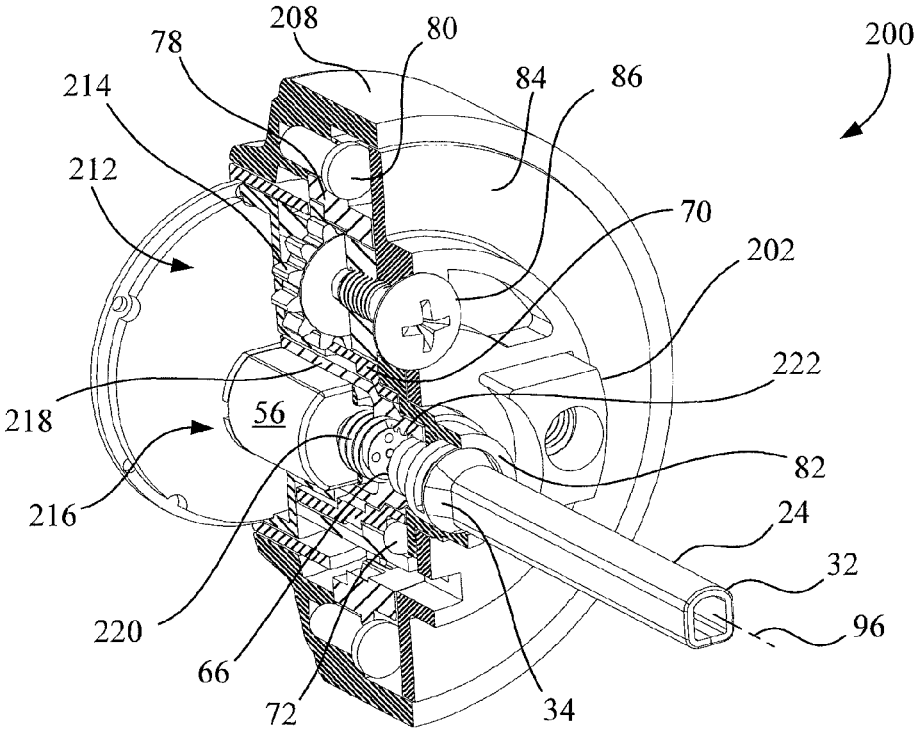
Figure 14D:
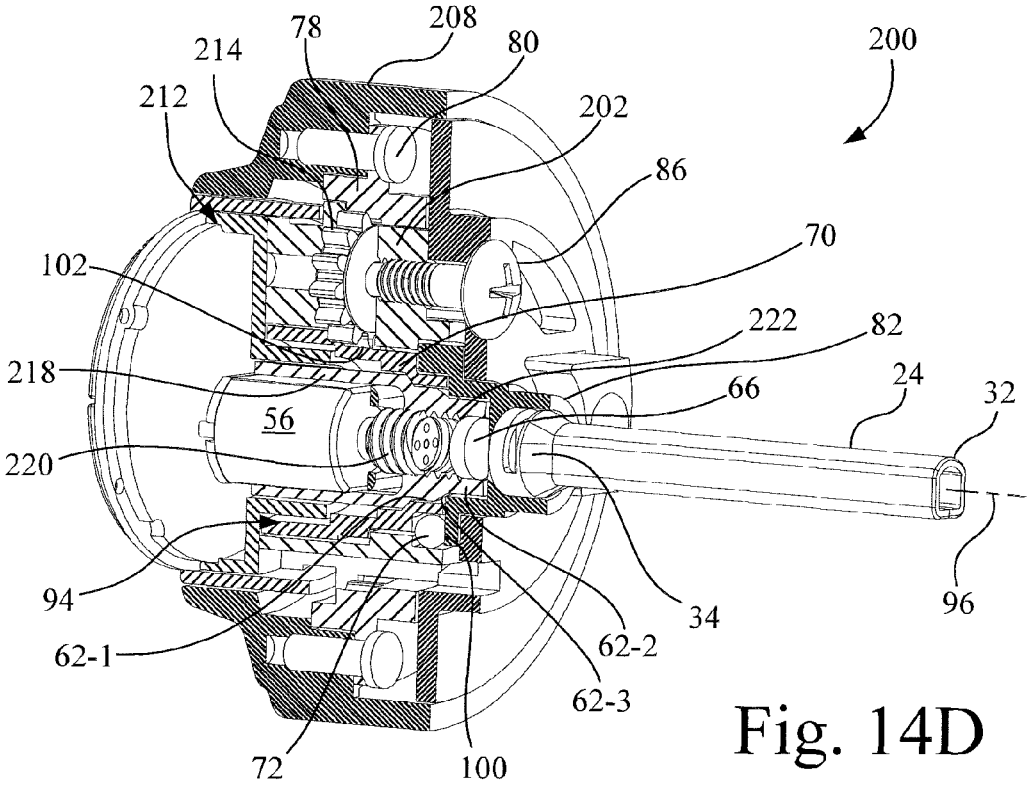

Gear sleeve 70 is configured to be rotatable around rotational axis 96, and is configured as described above with respect to the previous embodiment, and includes circumferential gear 102 having external gear teeth extending outwardly, and recess 106 (see FIGS. 16A-16C) located in distal sleeve portion 70-2 (see FIG. 14B). Recess 106 extends radially inwardly from an exterior surface of distal sleeve portion 70-2 toward rotational axis 96.

When ball bearing 72 is at least one-half received (as measured by the ball bearing diameter) in recess 106 of gear sleeve 70, ball bearing 72 rotatably fixes gear sleeve 70 to torque blade driver 82, such that gear sleeve 70 and torque blade driver 82 rotate in unison. When ball bearing 72 is less than one-half received (as measured by the ball bearing diameter) in recess 106 of gear sleeve 70, ball bearing 72 does not rotatably fix gear sleeve 70 to torque blade driver 82.

Actuator mechanism 216 is configured to selectively position the coupling member, e.g., ball bearing, 72 relative to recess 100 of torque blade driver 82 and recess 106 (see FIGS. 16A-16C) of gear sleeve 70 to select one of the locked condition and the unlocked condition. Thus, the positioning of ball bearing 72, which in the present embodiment is a ferromagnetic (e.g., steel) ball bearing, is achieved by actuator mechanism 216 and is dependent on the axial position of shifter 218 and magnet 66.

Shifter 218 has a proximal portion 62-1 having a first diameter and a distal portion 62-2 having a second diameter less than the first diameter. An annular bevel 62-3 of shifter 218 transitions between proximal portion 62-1 and distal portion 62-2. Magnet 66 is mounted to an end portion, i.e., at distal portion 62-2, of shifter 218.

Rotation of threaded drive 220 by motor 56 in a first rotational direction results in an axial displacement of shifter 218 in a first longitudinal direction, and rotation of threaded drive 220 in a second rotational direction opposite the first rotational direction results in an axial displacement of shifter 218 in a second longitudinal direction opposite the first longitudinal direction.

In the present embodiment, manually operable bezel 208, segmented touch pad 210, button cover 52, printed circuit board 54 and gear driver 78 form a freely rotatable bezel unit, the manually operable bezel assembly 204, which is rotatable relative to chassis body 202. Gear driver 78 has internal teeth which engage intermediate gear 214 and thus is rotatably coupled to circumferential gear 102 of gear sleeve 70.

Bezel screws 80 fixedly mount gear driver 78 to bezel 208.

Intermediate gear 214 in combination with the gearing of gear driver 78 and the gearing of gear sleeve 70, form a gear train wherein manually operable bezel 208 is always rotationally coupled to gear sleeve 70. Intermediate gear 214 is rotatably mounted by gear axle screw 86. Accordingly, in the assembly described above, a rotation of manually operable bezel 208 results in a rotation of gear sleeve 70.

Thus, in the present embodiment, manually operable bezel 208 is always drivably engaged with gear sleeve 70 via the rotatable gear driver 78 and intermediate gear 214. However, gear sleeve 70 is selectively engageable with torque blade driver 82 via the coupling member, e.g., ball bearing, 72.

Shifter 218 is drivably engaged by threaded drive 220, with threaded drive 220 being driven by motor 56, thus shifter 218 is configured for linear movement along rotational axis 96 to move magnet 66 to define a locked position (shifter 62 distally extended) corresponding to the locked condition and an unlocked position (shifter 62 proximally retracted) corresponding to the unlocked condition.

FIGS. 15A-16C depict exterior actuator assembly 200 with components positioned in the locked position to achieve the locked condition. The locked position is when the shifter 218/magnet 66 is in the extended distal position (shifted to the right in the orientation as shown) such that proximal portion 62-1 (shoulder) of shifter 218 can engage ball bearing 72. FIGS. 17A-18C depict exterior actuator assembly 200 with components positioned in the unlocked position to achieve the unlocked condition. The unlocked position is when the shifter 218/magnet 66 is in the retracted proximal position (shifted to the left in the orientation as shown) such that distal portion 62-2 of shifter 218 of the smaller diameter can engage bearing 72.

Figure 15A:
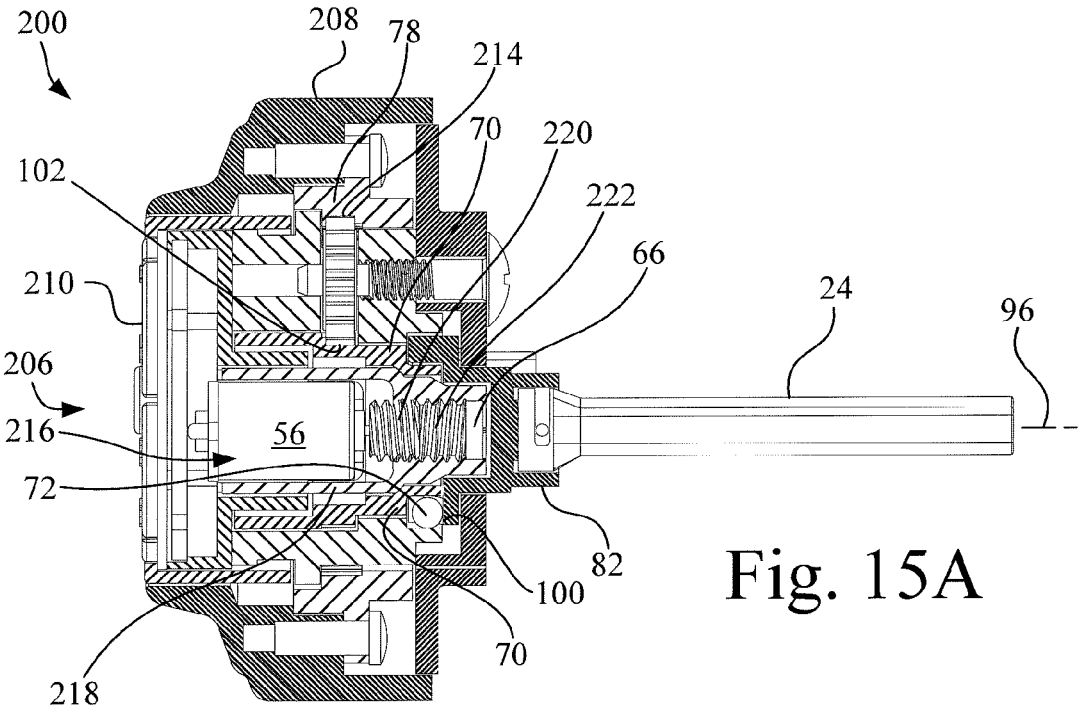
FIG. 15A is a sectional view of the exterior actuator assembly of FIGS. 12 and 13 with components positioned in the locked obstructed position.
Figure 15B:
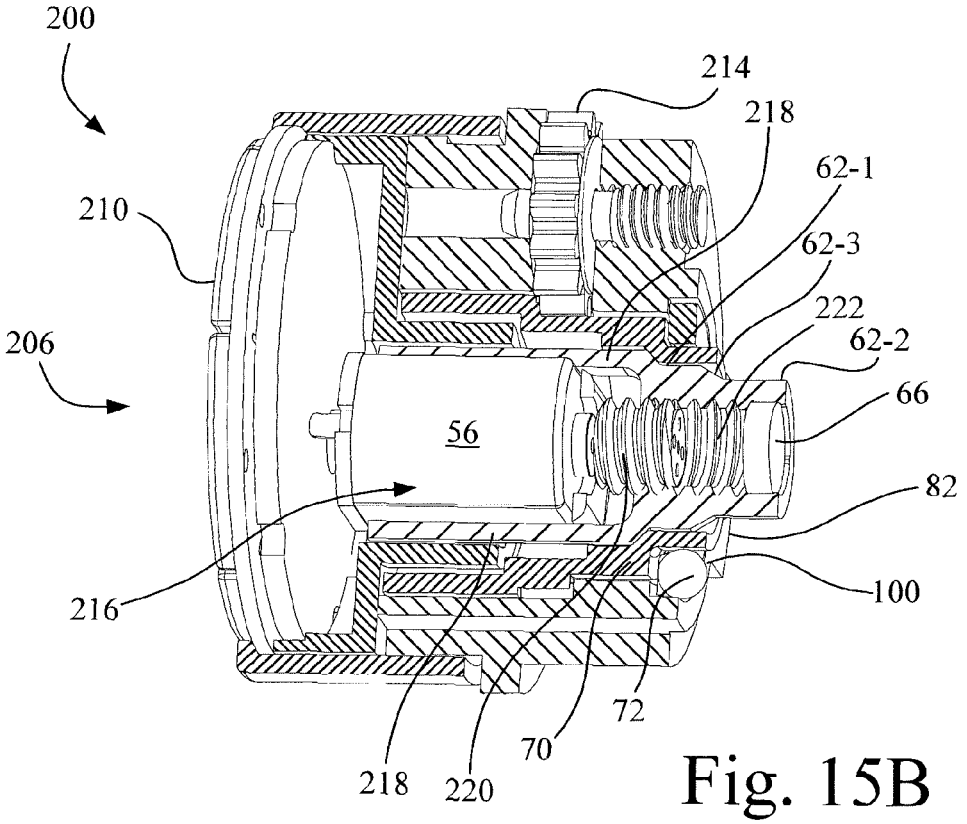
FIGS. 15B and 15C show sectional enlarged portion views of the exterior actuator assembly of FIG. 15A with components positioned in the locked obstructed position.
Figure 15C:
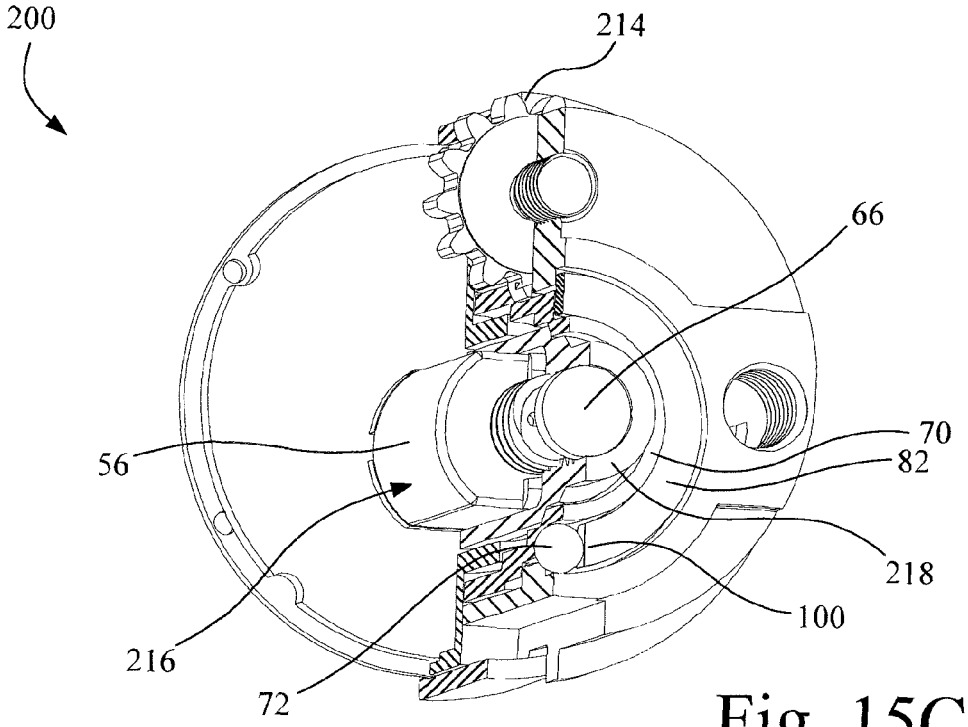

More particularly, FIGS. 15A-15C depict exterior actuator assembly 200 with components positioned in the locked obstructed condition. In the locked obstructed condition ball bearing 72 is positioned in the nest (channel) formed by recess 100 in torque blade driver 82 adjacent gear sleeve 70, such that gear sleeve 70 cannot drive torque blade driver 82.

Figure 16A:
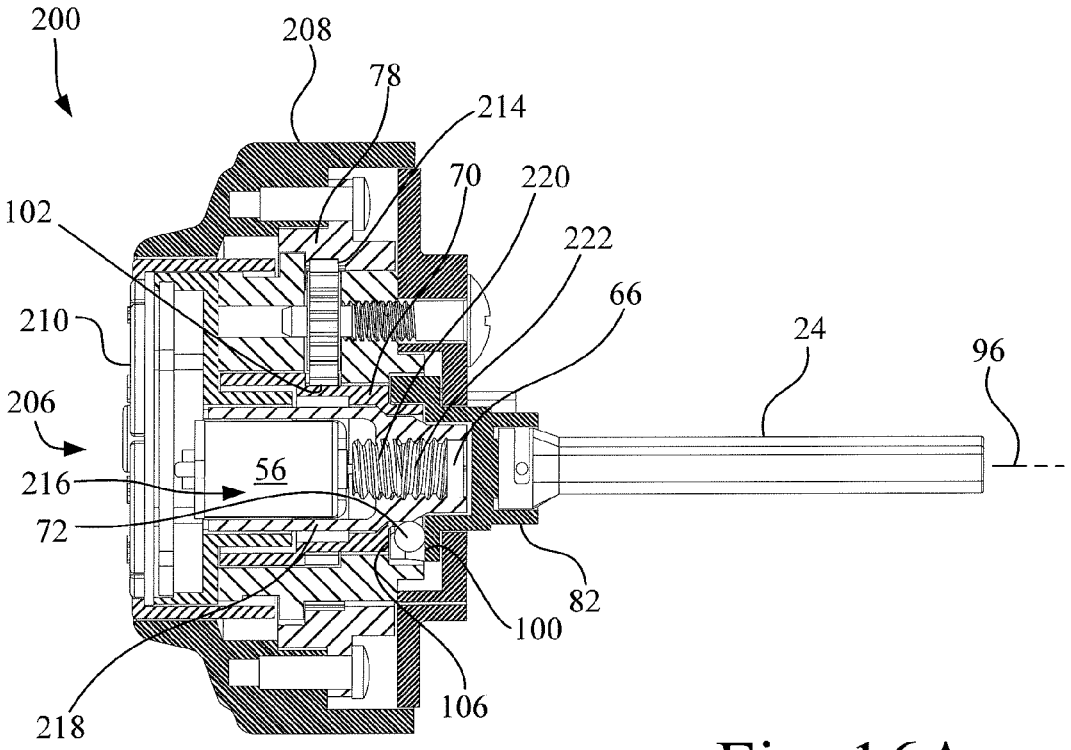
FIG. 16A is a sectional view of the exterior actuator assembly of FIGS. 12 and 13 with components positioned in the locked unobstructed position.
Figure 16B:
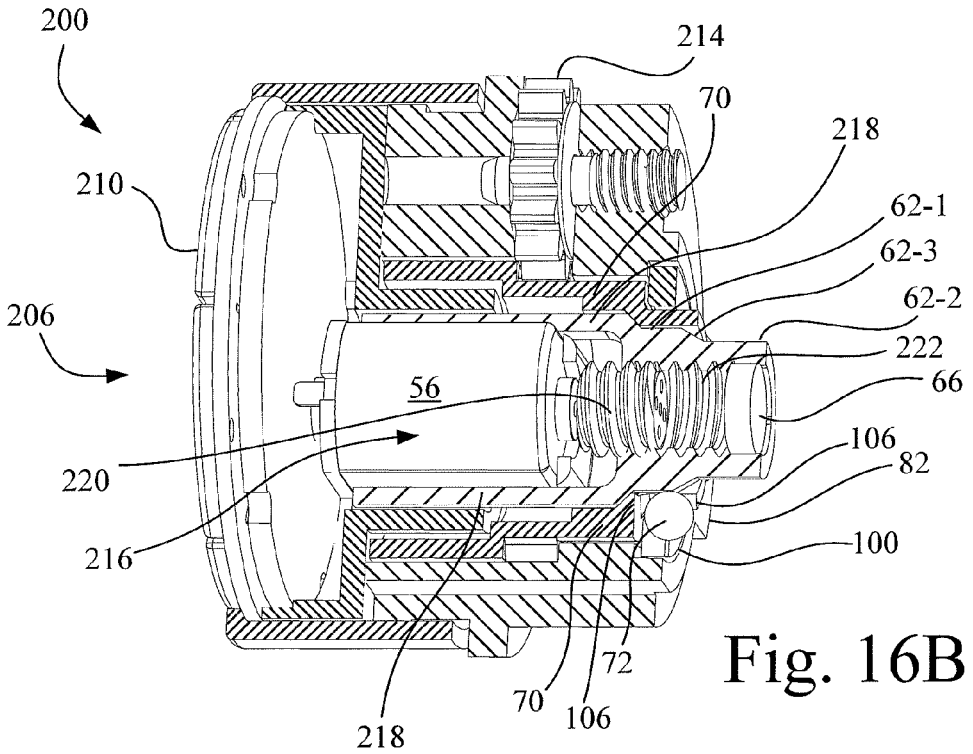
FIGS. 16B and 16C show sectional enlarged portion views of the exterior actuator assembly of FIG. 16A with components positioned in the locked unobstructed position.
Figure 16C:
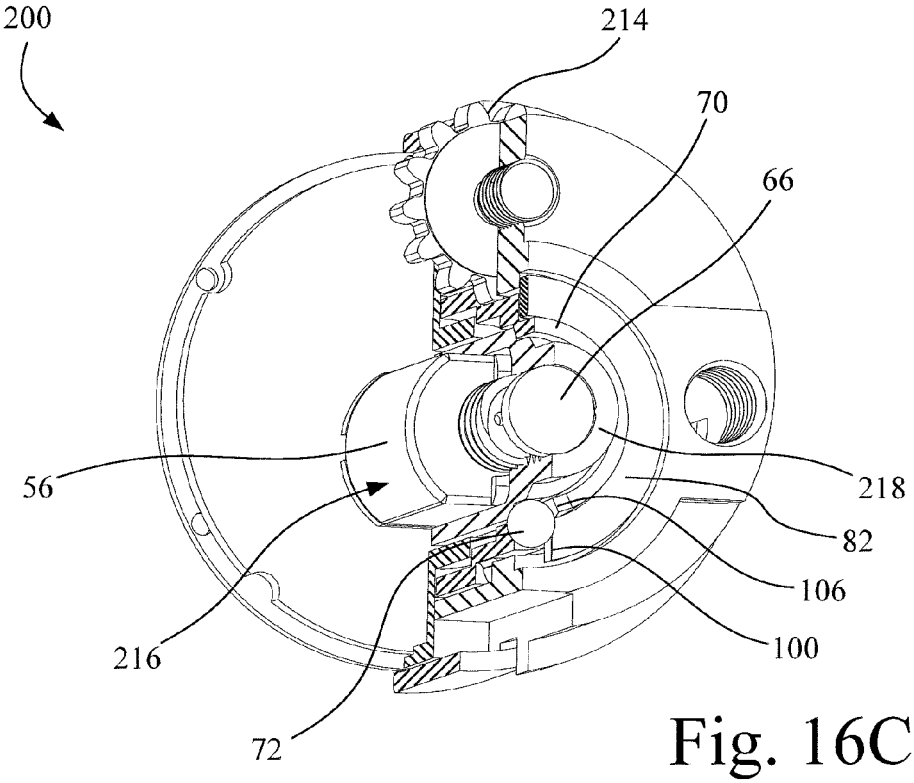

Also, as shown in FIGS. 16A-16C in the locked unobstructed condition, with shifter 218 in the extended distal position, proximal portion 62-1 (shoulder) on shifter 218 forces the coupling member, e.g., ball bearing 72, outwardly, such that when recess 106 in gear sleeve 70 is aligned with ball bearing 72 in recess 100 of torque blade driver 82 and gear sleeve 70 is rotated by manually operable bezel 208, the side surface of recess 106 of gear sleeve 70 strikes the ball bearing 72 below the ball centerline from the perspective of gear sleeve 70, (or above the ball centerline from the perspective of torque blade driver 82), thus forcing ball bearing 72 further outwardly (downwardly in the orientation as shown) into recess 100 of torque blade driver 82 to again achieve the locked obstructed condition, thus preventing a drivable coupling between gear sleeve 70 and torque blade driver 82.

Figure 17A:
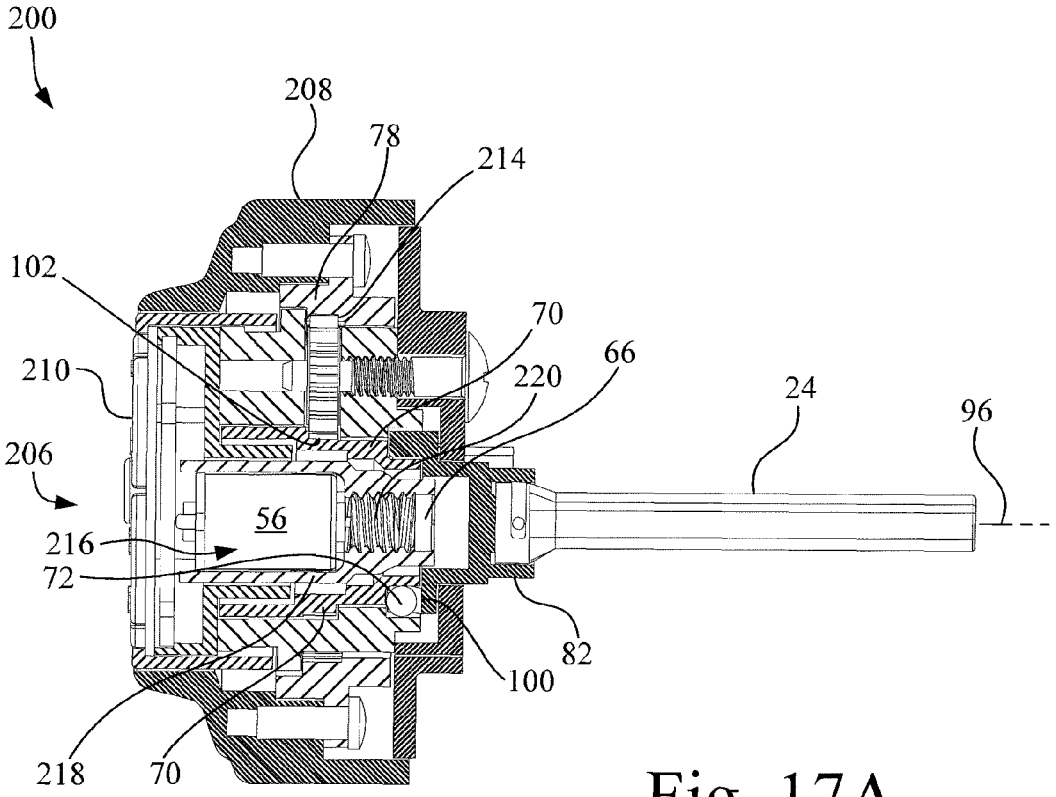
FIG. 17A is a sectional view of the exterior actuator assembly of FIGS. 12 and 13 with components positioned in the unlocked obstructed position.
Figure 17B:
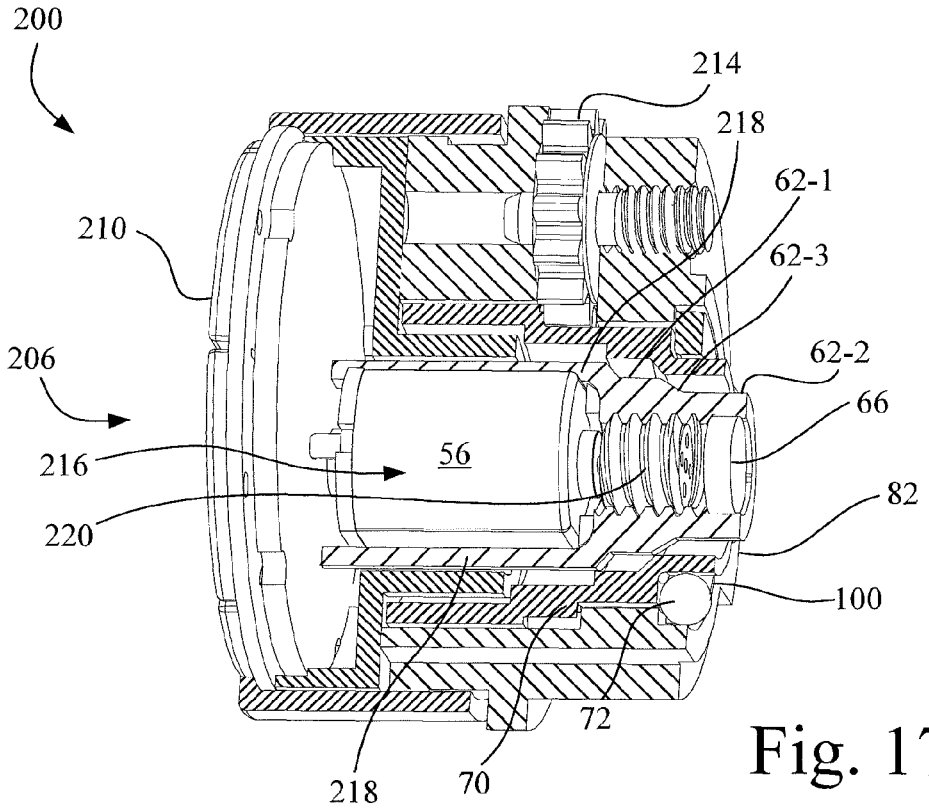
FIGS. 17B and 17C show sectional enlarged portion views of the exterior actuator assembly of FIG. 17A with components positioned in the unlocked obstructed position.
Figure 17C:
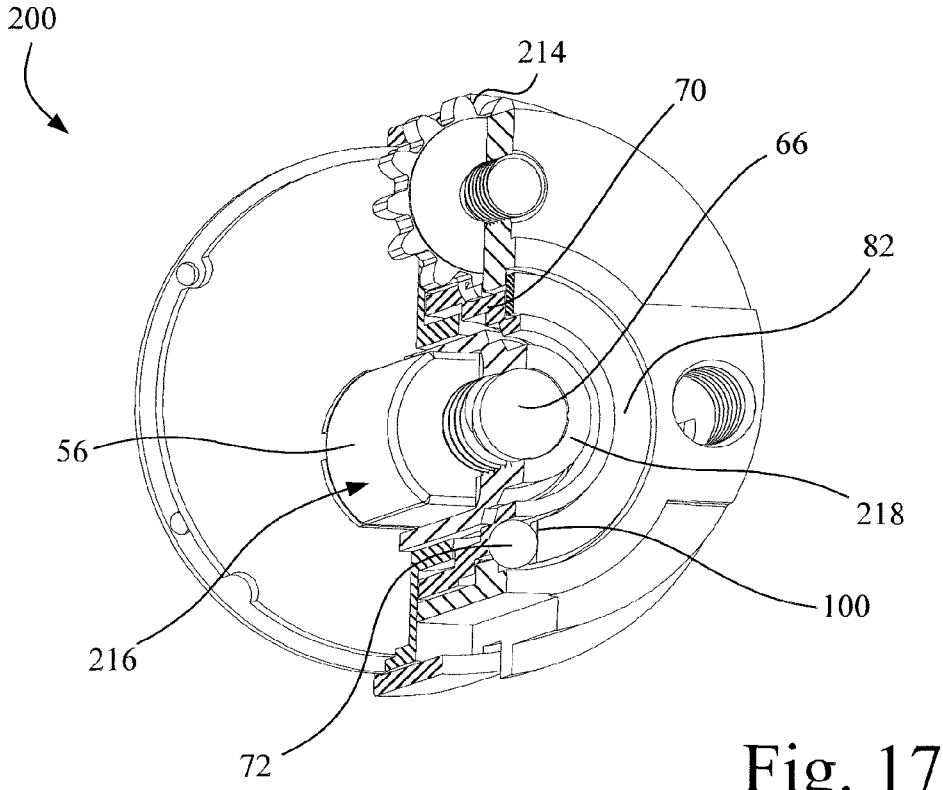

FIGS. 17A-17C depict exterior actuator assembly 200 with components positioned in the unlocked obstructed position, wherein the shifter 218/magnet 66 is positioned in the retracted proximal position, but recess 106 in gear sleeve 70 is not aligned with ball bearing 72 in recess 100 of torque blade driver 82. Thus, an initial rotation of manually operable bezel 208 will not result in the rotation of torque blade driver 82 until recess 106 in gear sleeve 70 is aligned with ball bearing 72 in recess 100 of torque blade driver 82 to achieve the unlocked unobstructed position depicted in FIGS. 18A-18C.

Figure 18A:
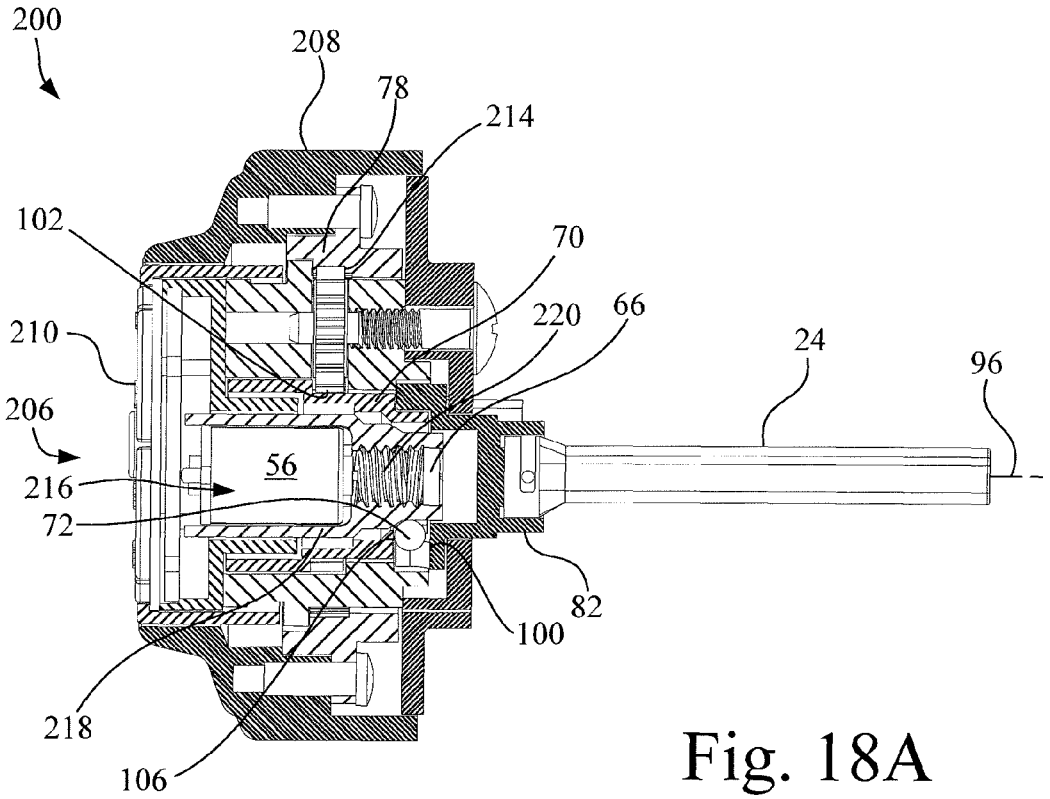
FIG. 18A is a sectional view of the exterior actuator assembly of FIGS. 12 and 13 with components positioned in the unlocked unobstructed position.
Figure 18B:
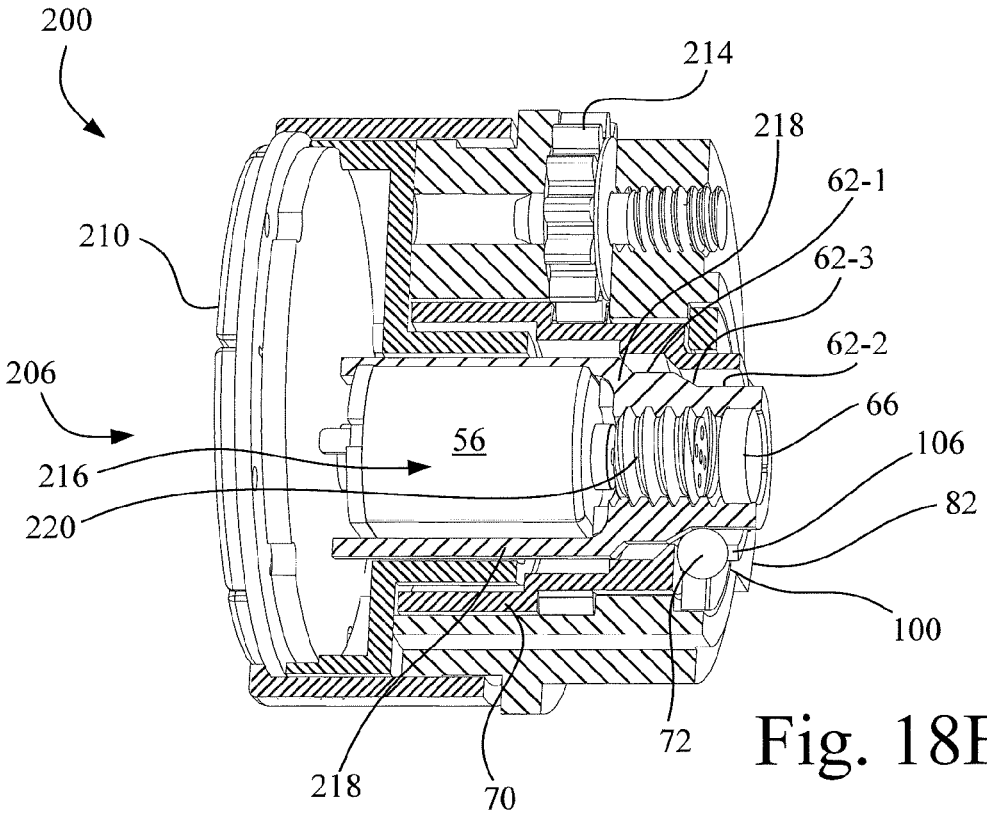
FIGS. 18B and 18C show sectional enlarged portion views of the exterior actuator assembly of FIG. 18A with components positioned in the unlocked unobstructed position.
Figure 18C:
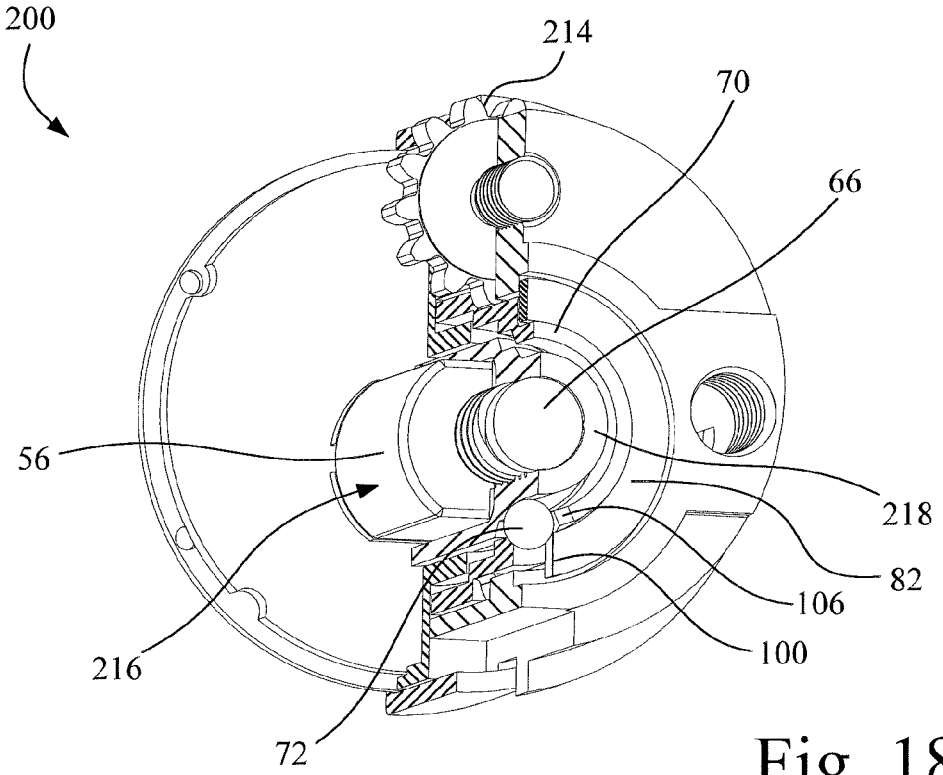

In the unlocked condition wherein the shifter 218/magnet 66 are in the retracted proximal position, ball bearing 72 is positioned in recess 100 in torque blade driver 82, but proximal portion 62-1 (shoulder) of shifter 218 is no longer in a position to force ball bearing 72 outwardly, such that when recess (nest) 106 in gear sleeve 70 is rotated into alignment with ball bearing 72 in recess 100 of torque blade driver 82, the ferromagnetic (e.g., steel) ball bearing 72 is attracted (lifted in the orientation as shown) by magnet 66 into recess 106 in gear sleeve 70 to achieve the unlocked unobstructed position depicted in FIGS. 18A-18C and into contact with the smallest diameter distal portion 62-2 of shifter 218.

In the unlocked unobstructed position depicted in FIGS. 18A-18C, when gear sleeve 70 is further rotated by rotation of exterior manually operable bezel 208, gear sleeve 70 will strike ball bearing 72 on or above the centerline of ball bearing 72 from the perspective of gear sleeve 70, (or on or below the centerline of ball bearing 72 from the perspective of torque blade driver 82), to maintain ball bearing 72 in the attracted (inward) position toward rotational axis 96. As such, ball bearing 72 couples gear sleeve 70 to torque blade driver 82 to permit operation of deadbolt mechanism 18 by rotation of exterior manually operable bezel 208.

In operation, the user will enter a valid access code on the keypad of segmented touch pad 210 of code input mechanism 206 associated with the exterior manually operable bezel 208, which in turn will actuate motor 56 to position shifter 218 to the unlocked position to attain the unlocked condition, thus permitting the operation, e.g., unlocking, of deadbolt mechanism 18 by retraction of retractable deadbolt 28 (see FIG. 1). When the valid access code is entered, the user has a predetermined period of time, e.g., 5 to 10 seconds, in which to rotate the exterior manually operable bezel 208 to retract (unlock) the retractable deadbolt 28 of deadbolt mechanism 18. After the period of time, motor 56 is driven to return shifter 218 back to the locked position to attain the locked condition.

In the present embodiment, as in the previous embodiment, motor 56 does not drive or in any way move the retractable deadbolt 28 of deadbolt mechanism 18. In the present embodiment, motor 56 is used to aid in coupling manually operable bezel 208 to torque blade driver 82 via the shifter 218/magnet 66/ball bearing 72/gear sleeve 70 arrangement. The magnet 66 provides selective biasing of ball bearing 72 towards rotational axis 96. Exterior actuator assembly 200 is configured such that rotational axis 96 is common to, for example, motor 56, gear sleeve 70, gear driver 78, threaded drive 220, torque blade driver 82 and torque blade 24.

Figure 19:
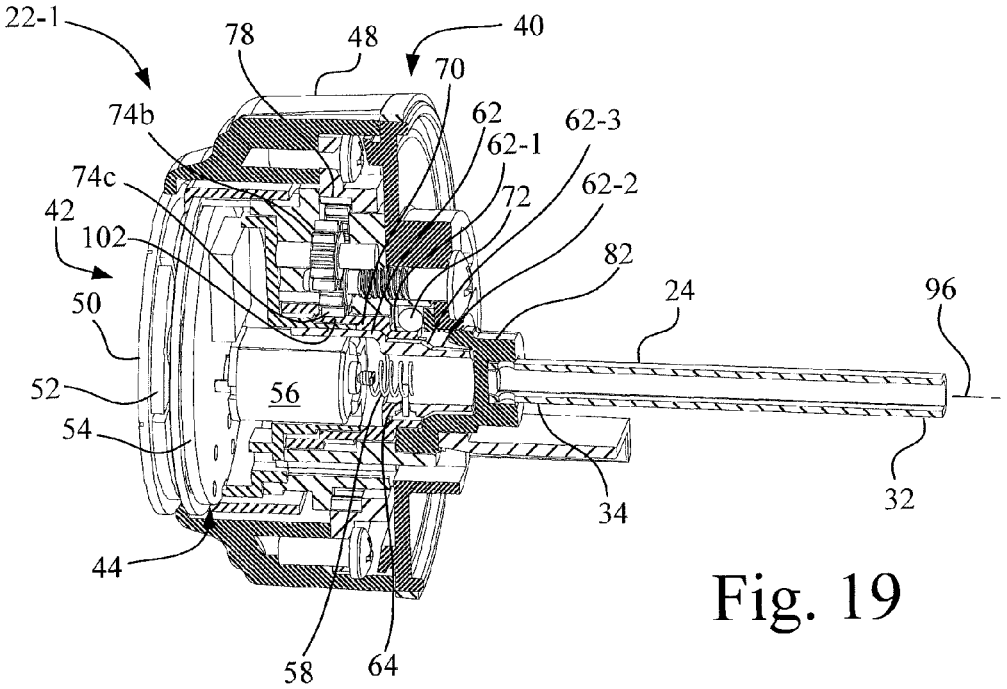
FIG. 19 is a section view of another alternate embodiment of an exterior actuator assembly suitable for use with the manually driven electronic deadbolt assembly of FIG. 1, with components positioned in the locked misaligned (obstructed) position.
Figure 20:
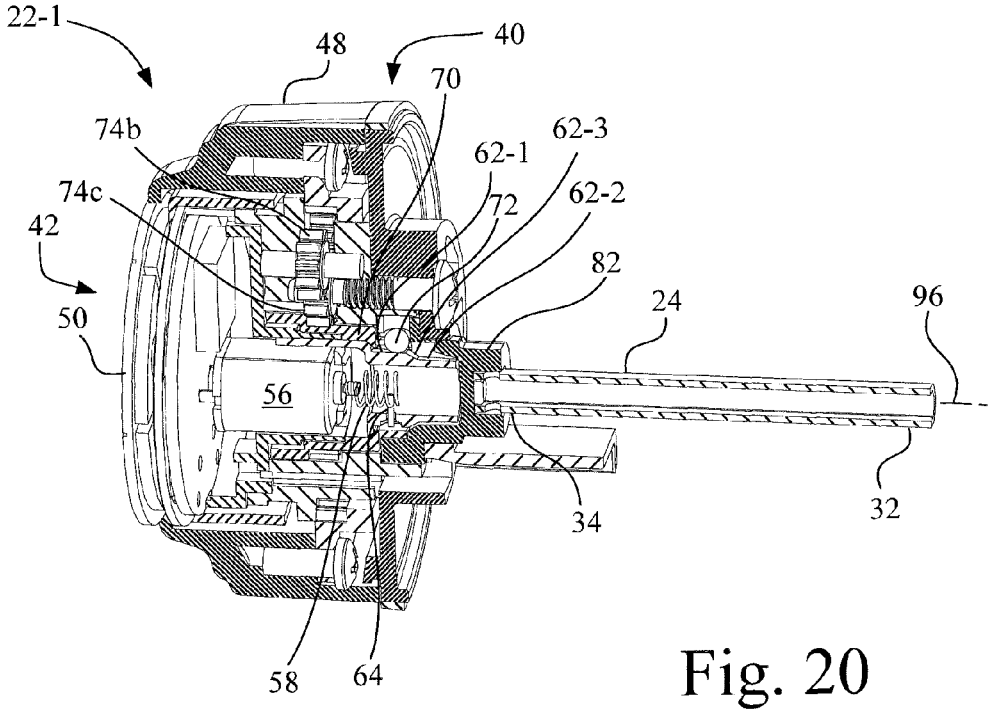
FIG. 20 is a section view of the exterior actuator assembly of FIG. 19, with components positioned in the locked aligned (unobstructed) position.
Figure 21:
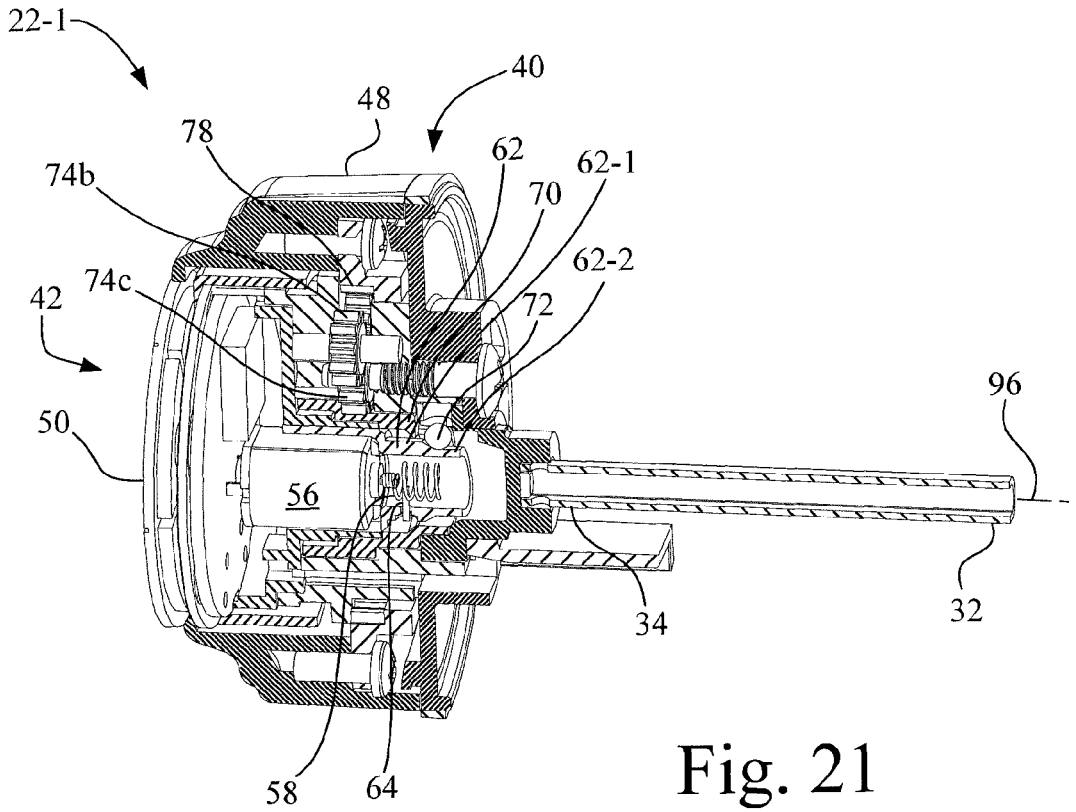
FIG. 21 is a section view of the exterior actuator assembly of FIG. 19 with components positioned in the unlocked position.

FIGS. 19-21 illustrate another alternative embodiment of exterior actuator assembly 22, identified as exterior actuator assembly 22-1. Exterior actuator assembly 22-1 is configured to selectively operate deadbolt mechanism 18 from the exterior space 14 and is structurally the same as exterior actuator assembly 22, except as follows: (a) exterior actuator assembly 22-1 excludes the magnet 66 of exterior actuator assembly 22, and thus coupling member 72 need not be made of a ferromagnetic material; (b) the inclusion of a single coupling member, e.g., single ball bearing, 72 which relies on gravity for placement; and (c) recess (channel) 100 of torque blade driver 82 and recess (channel) 106 of gear sleeve 70 are oriented to be vertical when exterior actuator assembly 22-1 is mounted on door 12, and when recess (channel) 100 of torque blade driver 82 and recess (channel) 106 of gear sleeve 70 are aligned, so as to utilize the effects of gravity on coupling member 72.

Due to the structural and operational similarities of exterior actuator assembly 22-1 to that of exterior actuator assembly 22, an abbreviated description of the current embodiment follows below. For more structural detail of individual components, the reader should refer to the description of components provided above in relation to FIGS. 1-11.

In the embodiment of exterior actuator assembly 22-1 depicted in FIGS. 19-21, the single ball bearing 72 is located to be generally vertically above shifter 62, such that gravity will act on ball bearing 72 to tend to position ball bearing 72 in contact with a surface of shifter 62, in the absence of misaligned components.

As shown in FIG. 19, depicting a locked misaligned (obstructed) condition, ball bearing 72 is nested in recess (channel) 100 in torque blade driver 82. In the locked orientation, recess (channel) 100 in torque blade driver 82 is generally vertical relative to axis of rotation 96 of the rotating components of exterior actuator assembly 22-1.

In FIG. 20, depicting a locked aligned (unobstructed) condition, manually operable bezel 48 has been rotated, such that recess (channel) 106 of gear sleeve 70 is vertically aligned with recess (channel) 100 in torque blade driver 82, and ball bearing 72 is pulled downwardly by gravity to contact shifter 62. Since shifter 62 is in the extended distal position, ball bearing 72 rests on proximal portion (shoulder) 62-1 of larger diameter of shifter 62, thus maintaining the locked condition.

If the gear sleeve 70 is rotated by the manually operable bezel 48, the side surface of recess (channel) 106 of gear sleeve 70 strikes the ball bearing 72 below the ball centerline, thus forcing ball bearing 72 further upwardly into recess (channel) 100 of torque blade driver 82 as shown in FIG. 19, thus preventing a drivable coupling between gear sleeve 70 and torque blade driver 82, and maintaining the locked condition.

In FIG. 21, shifter 62 has been moved to the retracted proximal position, and thus ball bearing 72 is now in its lowermost position and rests on the distal portion 62-2 of smaller diameter of shifter 62, thus placing exterior actuator assembly 22-1 in the unlocked condition. When the gear sleeve 70 is rotated by rotation of the outer manually operable bezel 48, the gear sleeve 70 will strike the ball bearing 72 on or above the centerline of ball bearing 72 to maintain ball bearing 72 in the lowered position toward rotational axis 96. As such, exterior actuator assembly 22-1 is in the unlocked condition, and ball bearing 72 couples gear sleeve 70 to torque blade driver 82 to permit operation of deadbolt mechanism 18 by rotation of the outer manually operable bezel 48.

In operation, the user will enter a valid access code on the keypad of segmented touch pad 50 of code input mechanism 42 associated with the exterior manually operable bezel 48, which in turn will actuate motor 56 to position shifter 62 to the unlocked position to attain the unlocked condition, thus permitting the operation, e.g., unlocking, of deadbolt mechanism 18 by retraction of retractable deadbolt 28. When the valid access code is entered, the user has a predetermined period of time, e.g., 5 to 10 seconds, in which to rotate the exterior manually operable bezel 48 to retract (unlock) the retractable deadbolt 28 of deadbolt mechanism 18. After the period of time, motor 56 is driven to return shifter 62 back to the locked position to attain the locked condition.

In the present embodiment, as in previous embodiments, motor 56 does not drive or in any way move the retractable deadbolt 28 of deadbolt mechanism 18. In the present embodiment, motor 56 is used to aid in coupling manually operable bezel 48 to torque blade driver 82 via the shifter 62/ball bearing 72/gear sleeve 70 arrangement. Gravity provides biasing of ball bearing 72 towards rotational axis 96. Exterior actuator assembly 22-1 is configured such that rotational axis 96 is common to, for example, motor 56, drive spring 58, gear sleeve 70, gear driver 78, torque blade driver 82 and torque blade 24.

Figure 22:
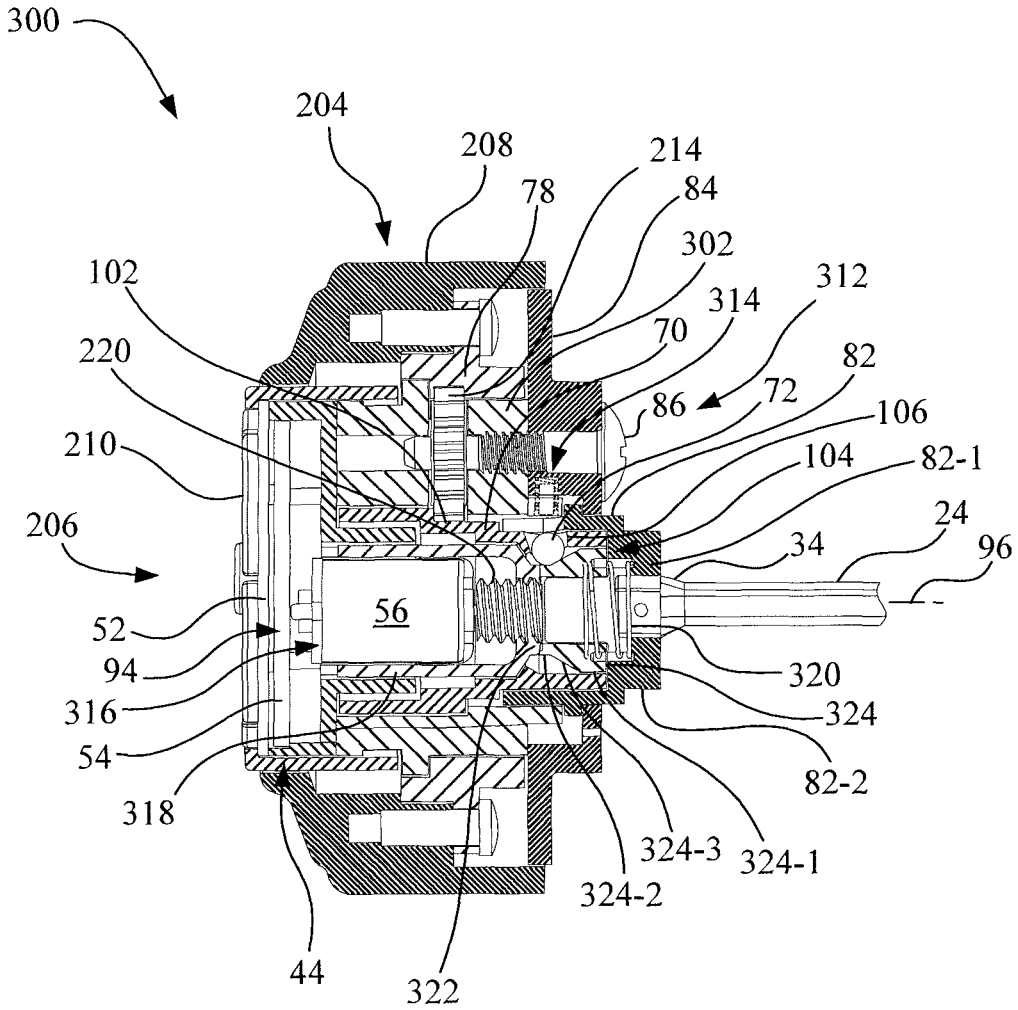
FIG. 22 is a perspective view of another alternate embodiment of an exterior actuator assembly suitable for use with the manually driven electronic deadbolt assembly of FIG. 1, with components positioned in the locked position.
Figure 23:
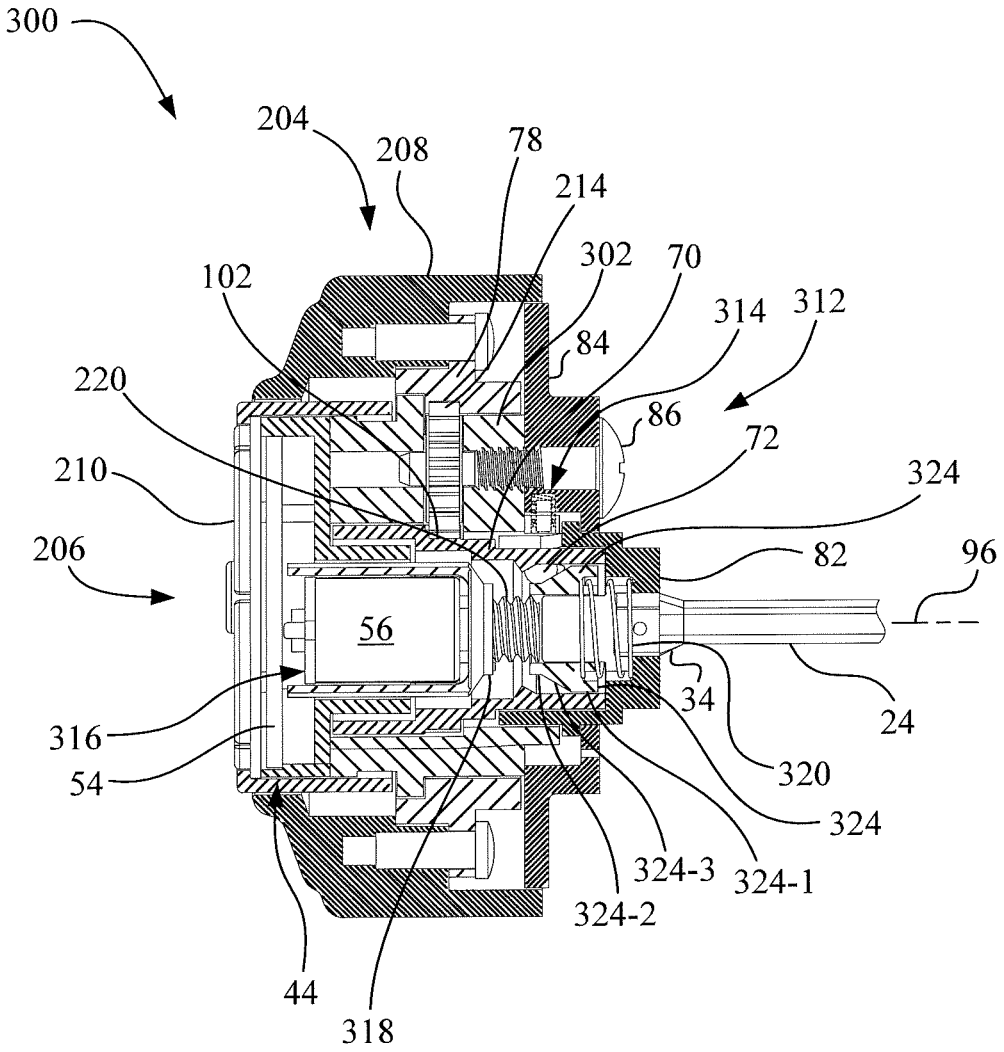
FIG. 23 is a perspective view of an exterior actuator assembly of FIG. 22 with components transitioning to the unlocked obstructed position.
Figure 24:
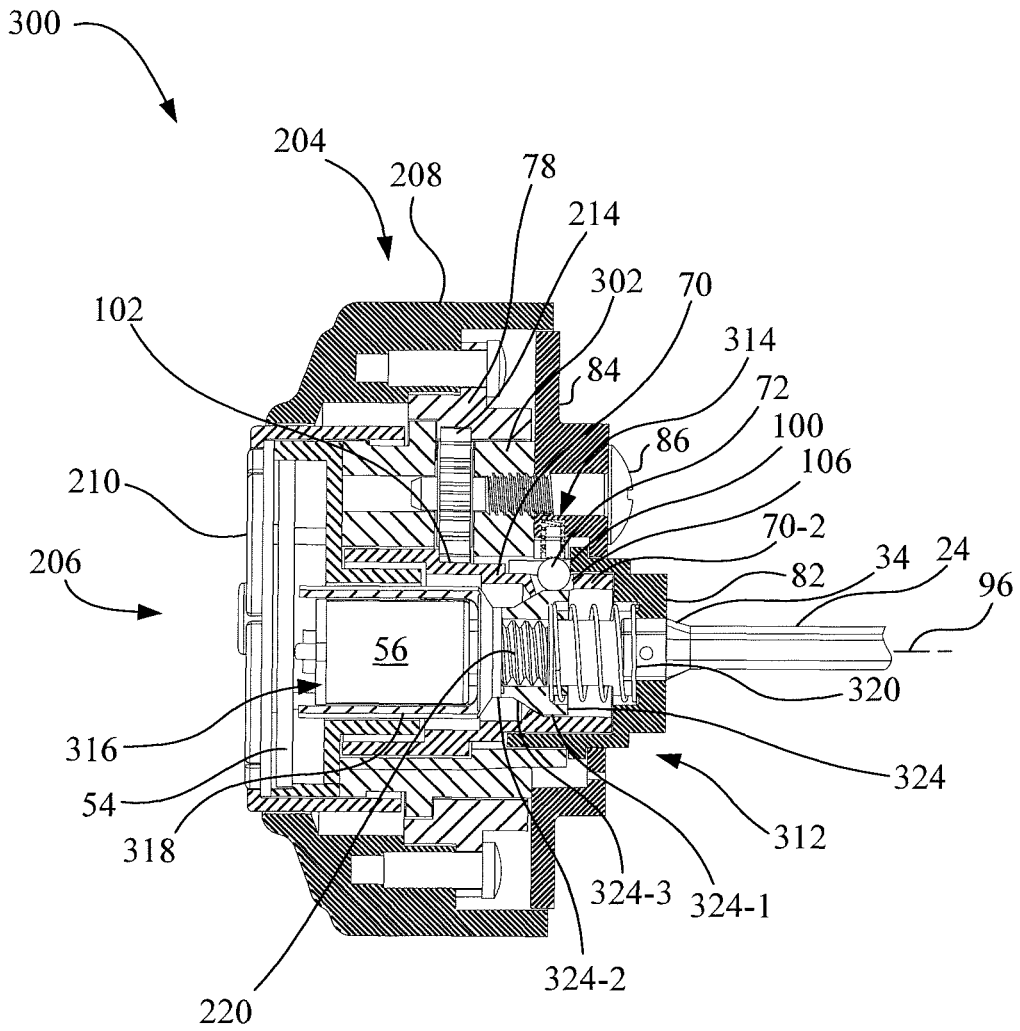
FIG. 24 is a perspective view of an exterior actuator assembly of FIG. 22 with components positioned in the unlocked position.

FIGS. 22-24 illustrate another alternative embodiment of exterior actuator assembly 22, identified as exterior actuator assembly 300.

Exterior actuator assembly 300 is configured to selectively operate deadbolt mechanism 18 from the exterior space 14 (see FIG. 1). The exterior actuator assembly 300 has a locked condition and an unlocked condition. In the locked condition, operation of deadbolt mechanism 18 is prohibited by drivably decoupling exterior actuator assembly 300 from deadbolt mechanism 18. In the unlocked condition, operation of deadbolt mechanism 18 is permitted by drivably coupling exterior actuator assembly 300 to deadbolt mechanism 18.

Exterior actuator assembly 300 includes many components common to that of exterior actuator assemblies 22 and 200, and thus unless stated otherwise, the components and function of the components of exterior actuator assembly 300 having the same element numerals as that of exterior actuator assemblies 22 and/or 200 will be presumed to be the same as that described above unless stated otherwise below, and thus for brevity such description will not be repeated in its entirety here.

Exterior actuator assembly 300 includes a chassis body 302, manually operable bezel assembly 204, and code input mechanism 206. Chassis body 302 is a non-rotatable chassis that is used to mount exterior actuator assembly 300 to the exterior of door 12. Manually operable bezel assembly 204 includes manually operable bezel 208 that is rotatably coupled to chassis body 302 and is configured to selectively operate deadbolt mechanism 18. Chassis body 302 includes opening 94 defining rotational axis 96.

Code input mechanism 206, which may include segmented touch pad 210, is coupled to chassis body 302, and is configured to receive an input code from a user. For example, segmented touch pad 210 has six input pad segments which correspond to the six input buttons 90 arranged in a circular pattern on button cover 52 (see FIG. 2), which in turn provide input signals to printed circuit board 54 of control circuit 44 described above.

Exterior actuator assembly 300 includes an electro-mechanical coupling mechanism 312 mounted to chassis body 302, and is configured to selectively couple the manually operable bezel 208 to torque blade 24. Electro-mechanical coupling mechanism 312 is communicatively coupled to control circuit 44 and is mechanically connected to the second end 34 of torque blade 24.

The electro-mechanical coupling mechanism 312 of exterior actuator assembly 22 is configured such that in the locked condition the manually operable bezel 208 is drivably decoupled from torque blade 24, in which the manually operable bezel 208 is free-spinning when rotated so as to be rendered incapable of rotating torque blade 24 to operate deadbolt mechanism 18.

Also, electro-mechanical coupling mechanism 312 is configured to drivably couple the manually operable bezel 208 to torque blade 24 when a valid code is input to code input mechanism 206 to facilitate the unlocked condition, such that a rotation of the manually operable bezel 208 effects a rotation of torque blade 24 to operate deadbolt mechanism 18 to selectively extend or retract the retractable deadbolt 28 (see FIG. 1).

Electro-mechanical coupling mechanism 312 includes gear sleeve 70, a single coupling member, e.g., a ball bearing, 72, a coupling member biasing assembly 314, intermediate gear 214, torque blade driver 82, and an actuator mechanism 316. Coupling member biasing assembly 314 may be formed as a spring loaded pin positioned in an aperture in chassis body 302 located vertically above coupling member, e.g., a ball bearing, 72.

Actuator mechanism 316 includes motor 56, a shifter 318, a biasing spring 320, and a rotational-to-linear translator mechanism that in the present embodiment is formed by threaded drive 220 (in the form of a worm gear or screw) and an internal axial threaded bore 322 of shifter 318, and an annular locking wedge 324. Threaded drive 220 is mounted to the rotatable shaft of motor 56 for rotation with the rotatable shaft. The external threads of threaded drive 220 threadably engage axial threaded bore 322 of shifter 318 to provide a linear translation of shifter 318. Locking wedge 324 is positioned at least in part in internal cavity 104 of gear sleeve 70. Biasing spring 320 is configured to continually bias annular locking wedge 324 toward shifter 318 along rotational axis 96.

Torque blade driver 82 is configured with a driver body 82-1, driver end 82-2, and recess 100 (see FIG. 24) as described above with respect to the previous embodiment. Torque blade driver 82 is axially retained in the second axial bore 94-2 of chassis body 302 by back cover 84. Recess 100 of torque blade driver 82 forms a nest for selectively receiving coupling member, e.g., ball bearing, 72, with the nest being configured to facilitate movement of ball bearing 72 in a radial direction relative to rotational axis 96 while torque blade driver 82 is radially restrained by chassis body 302.

Gear sleeve 70 is configured to be rotatable around rotational axis 96, and is configured as described above with respect to the previous embodiment, and includes circumferential gear 102 having external gear teeth extending outwardly, and recess 106 (see FIG. 24) located in distal sleeve portion 70-2. Recess 106 extends radially inwardly from an exterior surface of distal sleeve portion 70-2 toward rotational axis 96.

Actuator mechanism 316 is configured to selectively position the coupling member, e.g., ball bearing, 72 relative to recess 100 of torque blade driver 82 and recess 106 of gear sleeve 70 to select one of the locked condition and the unlocked condition. Thus, the positioning of ball bearing 72 is achieved by actuator mechanism 316, which in the present embodiment is dependent on the axial position of shifter 318 and annular locking wedge 324.

Annular locking wedge 324 has a distal portion 324-1 having a first diameter and a proximal portion 324-2 having a second diameter less than the first diameter. A proximally-facing wedge surface, such as an annular bevel 324-3 of annular locking wedge 324, transitions between distal portion 324-1 and proximal portion 324-2.

Rotation of threaded drive 220 by motor 56 in a first rotational direction results in an axial displacement of shifter 318 in a first longitudinal direction along axis 96, and rotation of threaded drive 220 in a second rotational direction opposite the first rotational direction results in an axial displacement of shifter 318 in a second longitudinal direction along rotational axis 96 opposite the first longitudinal direction. Due to the biasing effect provided by biasing spring 320, which is located between the distal end of annular locking wedge 324 and the second end 34 of torque blade 24, annular locking wedge 324 will tend to follow the longitudinal movement of shifter 318 unless longitudinal travel of annular locking wedge 324 toward shifter 318 is obstructed by the vertical position of coupling member, e.g., ball bearing, 72 (see FIG. 23).

In the present embodiment, the manually operable bezel 208, segmented touch pad 210, button cover 52, printed circuit board 54 and gear driver 78 form a freely rotatable bezel unit, the manually operable bezel assembly 204, which is rotatable relative to chassis body 302. Gear driver 78 has internal teeth which engage intermediate gear 214 and thus is rotatably coupled to circumferential gear 102 of gear sleeve 70.

Intermediate gear 214 in combination with the gearing of gear driver 78 and the gearing of gear sleeve 70 form a gear train wherein the manually operable bezel 208 is always rotationally coupled to gear sleeve 70. Intermediate gear 214 is rotatably mounted by gear axle screw 86. Accordingly, in the assembly described above, a rotation of manually operable bezel 208 results in a rotation of gear sleeve 70.

Thus, in the present embodiment, the manually operable bezel 208 is always drivably engaged with gear sleeve 70 via the rotatable gear driver 78 and intermediate gear 214. However, gear sleeve 70 is selectively engageable with torque blade driver 82 via the coupling member, e.g., ball bearing, 72.

Shifter 318 is drivably engaged by threaded drive 220, with threaded drive 220 being driven by motor 56, thus shifter 318 is configured for linear movement along rotational axis 96 to facilitate movement of annular locking wedge 324 to define a locked position as depicted in FIG. 22 with shifter 318 and annular locking wedge 324 in an extended distal position, corresponding to the locked condition. Also, shifter 318 is configured for linear movement along rotational axis 96 to facilitate movement of annular locking wedge 324 to define an unlocked position as depicted in FIG. 24 with shifter 318 and annular locking wedge 324 in a retracted proximal position along rotational axis 96, corresponding to the unlocked condition.

In FIG. 22, exterior actuator assembly 300 is in the locked condition, with the coupling member, e.g., ball bearing, 72 biased by coupling member biasing assembly 314 to the lowered position in contact with proximal portion 324-2 of annular locking wedge 324, such that gear sleeve 70 is not coupled to torque blade driver 82. In the locked condition, manually operable bezel 208 freely rotates about rotational axis 96 without operating deadbolt mechanism 18 (see FIG. 1).

To effect an unlocked condition of exterior actuator assembly 300, the user will enter a code on the segmented touch pad 210 of code input mechanism 206 associated with manually operable bezel assembly 204, which in turn will actuate motor 56 to retract shifter 318, which in turn annular locking wedge 324 to be pushed (to the left in the orientation as shown) by biasing spring 320 (see FIG. 23). As annular locking wedge 324 moves to the left the annular bevel 324-3 of annular locking wedge 324 lifts coupling member, e.g., ball bearing, 72 against the biasing effect of coupling member biasing assembly 314 to rotatably couple torque blade driver 82 with gear sleeve 70 (FIG. 24). The exterior actuator assembly 300 is now in the unlocked condition and the user may now manually rotate the manually operable bezel 208 of manually operable bezel assembly 204, which in turn will drive the couple torque blade driver 82 to rotate torque blade 24 to effect operation of deadbolt mechanism 18, thus retracting the retractable deadbolt 28.

When the valid access code is entered, the user has a predetermined period of time, e.g., 5 to 10 seconds, in which to rotate the exterior manually operable bezel 208 to retract (unlock) retractable deadbolt 28 of deadbolt mechanism 18. After the period of time, motor 56 is driven to return shifter 218 back to the locked position to attain the locked condition.

In the present embodiment, as in the previous embodiments, motor 56 does not drive or in any way move the retractable deadbolt 28 of deadbolt mechanism 18. In the present embodiment, motor 56 is used to aid in coupling the manually operable bezel 208 to torque blade driver 82 via the shifter 318/annular locking wedge 324/ball bearing 72/gear sleeve 70 arrangement. Coupling member biasing assembly 314 provides biasing of ball bearing 72 towards rotational axis 96. Exterior actuator assembly 300 is configured such that rotational axis 96 is common to, for example, motor 56, gear sleeve 70, gear driver 78, threaded drive 220, torque blade driver 82 and torque blade 24.

Figure 25:
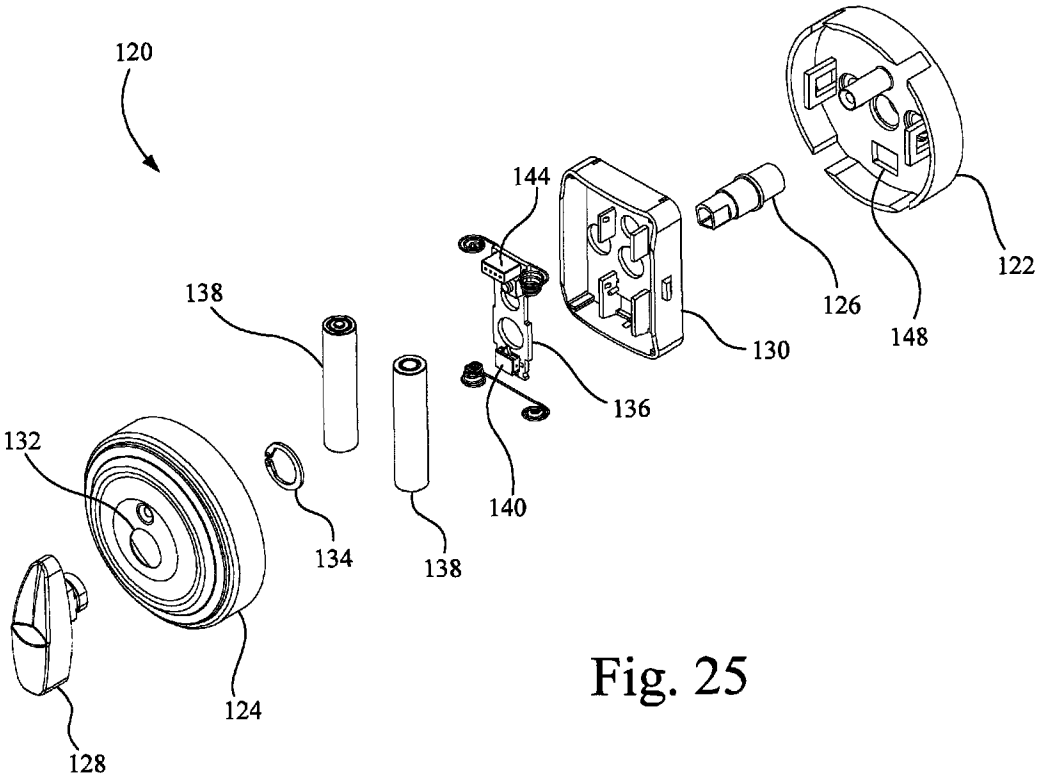
FIG. 25 is an exploded view of the interior actuator assembly of FIGS. 1-3.
Figure 26:
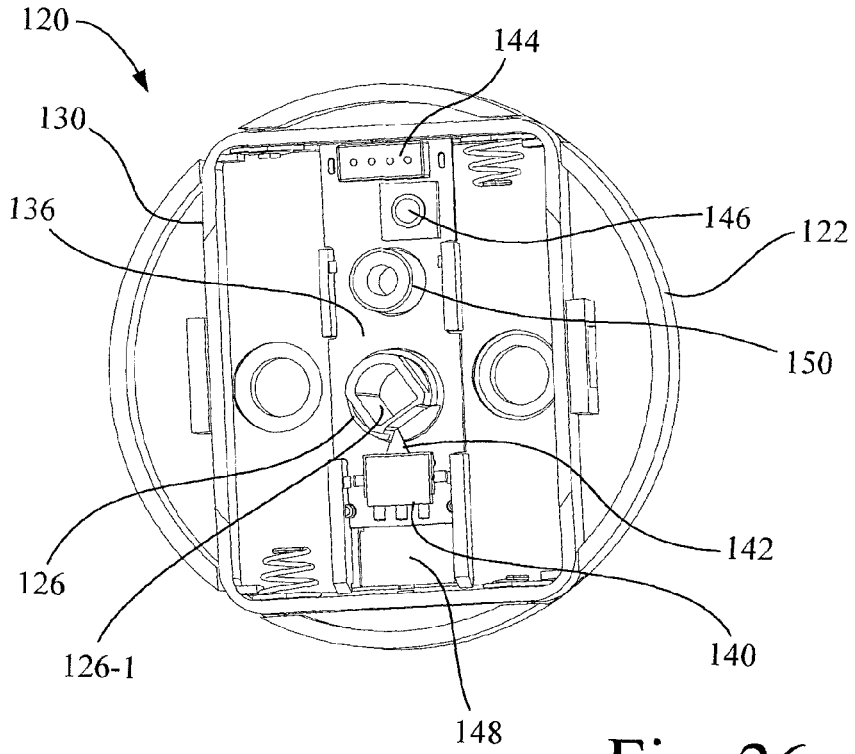
FIG. 26 shows an interior (door side) of the interior actuator assembly of FIGS. 1-3, with the batteries removed.
Figure 27:
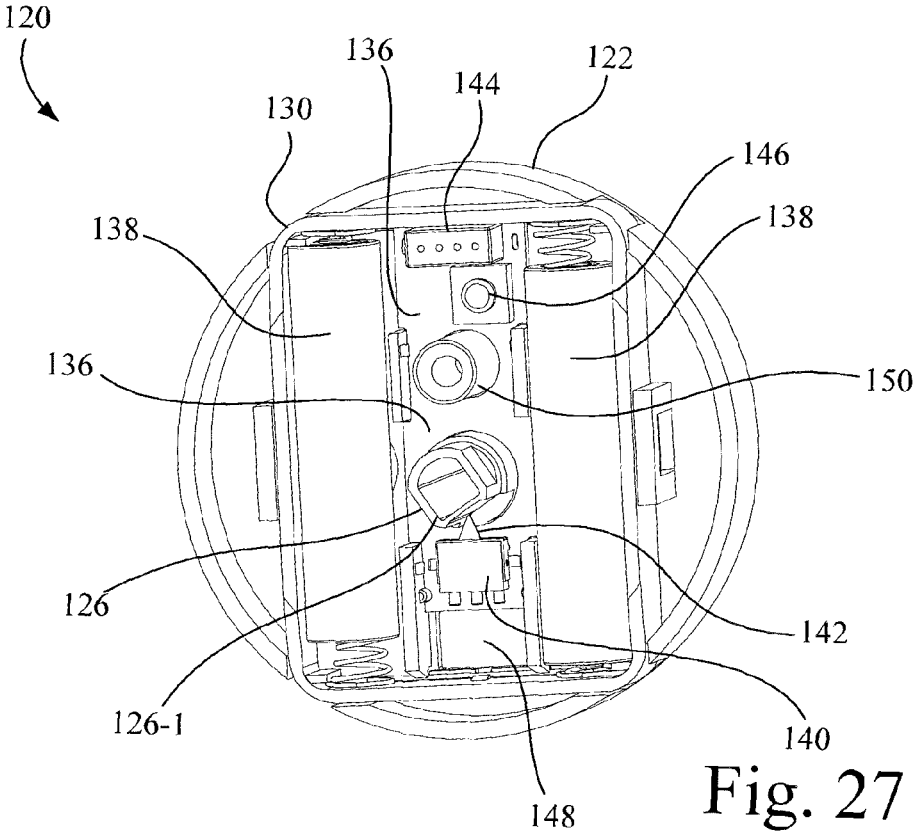
FIG. 27 shows the interior of the interior actuator assembly of FIG. 26, with the batteries installed.

Referring now to FIGS. 25-27, there is shown detailed drawings of interior actuator assembly 120 introduced above with respect to FIGS. 1-3. Interior actuator assembly 120 is suitable for use in conjunction with any of the exterior actuator assemblies 22, 22-1, 200 and 300, described above.

Interior actuator assembly 120 includes base 122 to which is attached a battery holder 130 and cover 124. Cover 124 has an opening 132 for mounting interior turn piece 128 via a ring retainer 134. Interior torque blade driver 126 is drivably attached to interior turn piece 128. Interior torque blade driver 126 has a shaped opening 126-1 for drivably receiving the first end 32 of torque blade 24 (see FIG. 1). Thus, from the interior of door 12, e.g., at secured space 16, interior turn piece 128 is always drivably coupled to torque blade 24, and in turn, is always operatively connected to deadbolt mechanism 18.

Battery holder 130 mounts an interior chassis 136, which may be in the form of a printed circuit board 136. Battery holder 130 is configured to accommodate two AAA batteries 138 which provide electrical power to all electrical components of both interior actuator assembly 120 and the respective exterior actuator assembly 22, 22-1, 200 and 300. Battery holder 130 is snapped into position on interior base 122. Interior chassis 136 includes a switch 140 having a protruding actuator 142, a wiring connector 144, and a programming button 146. Actuator 142 of switch 140 is positioned to be selectively actuated by a camming action caused by a rotation of interior torque blade driver 126. Interior base 122 has a wiring channel 148 for receiving a wiring harness from an exterior actuator assembly, e.g., one of the exterior actuator assemblies 22, 22-1, 200 and 300 described above, which in turn is electrically coupled to wiring connector 144. Interior base 122 has a single post 150 for mounting cover 124 via a screw.

In FIGS. 26 and 27, the switch 140/actuator 142 is shown in the closed condition with interior turn piece 128 and interior torque blade driver 126 rotatably positioned in the locked condition, and as such motor 56 (see, e.g., FIGS. 6 and 10) is electrically disengaged. Switch 140 may be configured, for example, as a normally open switch. When switch 140 changes state, from closed to open by rotation of interior turn piece 128 to the unlocked condition, the control logic of printed circuit board 54 of control circuit 44 of the exterior actuator assembly causes motor 56 to unlock, i.e., to move the respective shifter 62, 218, 318 to the unlocked position (see, e.g., FIG. 11). When switch 140 is in the open state (unlocked position) motor 56 and shifter 62, 218, 318 remains in the unlocked position, but motor 56 is electrically disengaged and thus does not use any power.

Programming button 146 of interior actuator assembly 120 is provided to allow the programming of the memory of printed circuit board 54 of control circuit 44 of the exterior actuator assembly with a plurality of unique user access codes. During operation, a valid access code is entered on the segmented touch pad 50, 210 associated with the exterior manually operable bezel 48, 208 to permit the unlocking of deadbolt mechanism 18. When the access code is entered, the user has a predetermined period of time, e.g., 5 to 10 seconds, in which to rotate the exterior manually operable bezel 48, 208 to unlock deadbolt mechanism 18. After the period of time, the motor/shifter is returned back to the locked condition.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A manually driven electronic deadbolt assembly for use on a door separating an exterior space from a secured space, comprising:

a deadbolt mechanism having a spindle drive opening;

a torque blade configured to be drivably received in the spindle drive opening of the deadbolt mechanism, the torque blade having a first end and a second end;

an interior actuator assembly configured to operate the deadbolt mechanism from the secured space, the interior actuator being mechanically connected to the first end of the torque blade; and an exterior actuator assembly configured to operate the deadbolt mechanism from the exterior space, the exterior actuator assembly having a locked condition and an unlocked condition, the exterior actuator assembly having:

a chassis body configured to mount the exterior actuator assembly to the door;

a manually operable bezel rotatably coupled to the chassis body and configured to selectively operate the deadbolt mechanism;

a code input mechanism coupled to the chassis body, the code input mechanism being configured to receive an input code from a user;

a control circuit coupled in electrical communication with the code input mechanism, the control circuit being configured with control logic to discriminate between a valid input code and an invalid input code;

an electro-mechanical coupling mechanism mounted to the chassis body, and configured to selectively couple the manually operable bezel to the torque blade, the electro-mechanical coupling mechanism being communicatively coupled to the control circuit and mechanically connected to the second end of the torque blade;

the electro-mechanical coupling mechanism being configured such that in the locked condition the manually operable bezel is drivably decoupled from the torque blade in which the manually operable bezel is free-spinning when rotated and incapable of rotating the torque blade to operate the deadbolt mechanism;

the electro-mechanical coupling mechanism being configured to drivably couple the manually operable bezel to the torque blade when the valid input code is input to the code input mechanism to facilitate the unlocked condition in which a rotation of the manually operable bezel effects a rotation of the torque blade to operate the deadbolt mechanism;

wherein the electro-mechanical coupling mechanism comprises a torque blade driver rotatable around the rotational axis, the torque blade driver having a driver body having a driver end configured to drivably engage the second end of the torque blade, the torque blade driver having a proximal cavity with the driver body having a first recess that extends radially outwardly from the proximal cavity into the driver body;

a gear sleeve rotatable around the rotational axis and rotatably coupled to the manually operable bezel, the gear sleeve having a sleeve body with a distal sleeve portion configured to be rotatably received in the proximal cavity of the torque blade driver, the sleeve body having a proximal sleeve portion with a circumferential gear having external gear teeth extending outwardly from the sleeve body, the sleeve body having an internal cavity, the sleeve body having a second recess in the distal sleeve portion that extends radially inwardly from an exterior surface of the distal sleeve portion;

a coupling member configured to be radially positioned in at least one of the first recess of the torque blade driver and the second recess of the gear sleeve; and an actuator mechanism configured to selectively position the coupling member relative to the first recess of the torque blade driver and the second recess of the gear sleeve to select one of the locked condition and the unlocked condition.

2. The manually driven electronic deadbolt assembly of claim 1, wherein the actuator mechanism is configured to position the coupling member to drivably engage both the first recess of the torque blade driver and the second recess of the gear sleeve when the electro-mechanical coupling mechanism is in the unlocked condition to rotatably fix the gear sleeve to the torque blade driver, and configured to position the coupling member to drivably disengage from one of the first recess of the torque blade driver and the second recess of the gear sleeve when the electro-mechanical coupling mechanism is in the locked condition to rotatably decouple the gear sleeve from the torque blade driver.

3. The manually driven electronic deadbolt assembly of claim 2, wherein the electro-mechanical coupling mechanism is configured such that:

when the coupling member drivably engages both the first recess of the torque blade driver and the second recess of the gear sleeve, the torque blade is operable via a rotation of the manually operable bezel which in turn rotates the gear sleeve and the torque blade driver; and when the coupling member does not drivably engage both the first recess of the torque blade driver and the second recess of the gear sleeve the torque blade is not operable via a rotation of the manually operable bezel.

4. The manually driven electronic deadbolt assembly of claim 1, wherein the coupling member is a ball bearing made of a ferromagnetic material, and the actuator mechanism comprises:

a motor having a rotatable shaft, the motor being electrically connected to the control circuit;

a shifter positioned in the internal cavity of the gear sleeve, the shifter having a shifter body and a magnet attached to the shifter body, the shifter being configured for linear movement within the internal cavity of the gear sleeve along the rotational axis to move the magnet to define a locked position corresponding to the locked condition and an unlocked position corresponding to the unlocked condition; and a rotational-to-linear translator mechanism coupled between the rotatable shaft of the motor and the shifter, wherein a rotation of the rotatable shaft in a first rotational direction causes the magnet of the shifter to linearly translate from the locked position to the unlocked position, and a rotation of the rotatable shaft in a second rotational direction opposite of the first rotational direction causes the magnet of the shifter to linearly translate from the unlocked position to the locked position.

5. The manually driven electronic deadbolt assembly of claim 4, configured such that when the shifter is in the unlocked position and the first recess and the second recess are in radial alignment, the ball bearing is magnetically attracted to the magnet to cause at least one-half of the ball bearing to be received in the second recess of the gear sleeve to rotatably fix the gear sleeve to the torque blade driver in a driving arrangement.

6. The manually driven electronic deadbolt assembly of claim 4, wherein the shifter has a proximal portion having a first diameter and a distal portion having a second diameter less than the first diameter, and has an annular bevel that transitions between the proximal portion and the distal portion, and configured such that when the shifter translates from the unlocked position to the locked position the ball bearing rides along the annular bevel to the proximal portion to reposition the ball bearing such that less than one-half of the ball bearing is received in the second recess of the gear sleeve such that the gear sleeve is no longer rotatably fixed to the torque blade driver in a driving arrangement.

7. The manually driven electronic deadbolt assembly of claim 4, wherein the internal cavity of the gear sleeve is a longitudinal bore, and a portion of the shifter is axially slidably received in the longitudinal bore of the gear sleeve.

8. The manually driven electronic deadbolt assembly of claim 4, wherein the shifter has an axial bore having an inner circumferential portion, and the rotational-to-linear translator mechanism includes:

a drive spring mounted to the rotatable shaft of the motor for rotation with the rotatable shaft, the drive spring having a plurality of coils; and a pin that radially projects from the inner circumferential portion of the shifter toward the rotational axis, with a distal portion of the pin being drivably received between the coils of the drive spring.

9. The manually driven electronic deadbolt assembly of claim 4, wherein the rotational-to-linear translator mechanism includes:

an axial threaded bore formed in the shifter; and a threaded drive mounted to the rotatable shaft of the motor for rotation with the rotatable shaft, the threaded drive having external threads that threadably engage the axial threaded bore of the shifter.

10. The manually driven electronic deadbolt assembly of claim 1, comprising:

a shifter positioned in the internal cavity of the gear sleeve, the shifter being configured for linear movement within the internal cavity of the gear sleeve along the rotational axis to define a locked position corresponding to the locked condition and an unlocked position corresponding to the unlocked condition;

a locking wedge positioned in the internal cavity of the gear sleeve, the locking wedge having a proximal portion having a first diameter and a distal portion having a second diameter greater than the first diameter, and a proximally-facing wedge surface that transitions from the proximal portion to the distal portion;

a spring configured to bias the locking wedge toward a distal end of the shifter; and a coupling member biasing assembly configured to bias the coupling member toward the locking wedge.

11. The manually driven electronic deadbolt assembly of claim 10, the actuator mechanism comprises:

a motor having a rotatable shaft, the motor being electrically connected to the control circuit;

a threaded drive mounted to the rotatable shaft of the motor for rotation with the rotatable shaft, the threaded drive having external threads; and the shifter having a proximal cavity configured to receive an external surface of the motor, and having an axial threaded bore having threads that threadably engage the external threads of the threaded drive, and the distal end of the shifter configured to axially engage the proximal portion of the locking wedge.

12. The manually driven electronic deadbolt assembly of claim 10, configured wherein:

when the shifter translates from the locked position to the unlocked position the coupling member, configured as a ball bearing, rides along a surface of the locking wedge from the proximal portion up an annular bevel to the distal portion such that the ball bearing is received in the first recess of the torque blade driver to rotatably fix the gear sleeve to the torque blade driver in a driving arrangement; and when the shifter translates from the unlocked position to the locked position the ball bearing rides along the surface of the locking wedge from the distal portion down the annular bevel to the proximal portion such that the ball bearing is received only in the second recess of the gear sleeve such that the gear sleeve is no longer rotatably fixed to the torque blade driver in the driving arrangement.

13. The manually driven electronic deadbolt assembly of claim 1, wherein the code input mechanism has an exterior surface and includes a pair of electrical contacts positioned on the exterior surface, the pair of electrical contacts being configured to facilitate application of external electrical power to the control circuit for operation of the exterior actuator assembly in the event of a power failure of an internal power source of the exterior actuator assembly.

14. The manually driven electronic deadbolt assembly of claim 1, the interior actuator assembly comprising:

an interior turn piece;

an interior base to which is attached a battery holder and a cover, the cover having an opening for mounting the interior turn piece;

an interior torque blade driver drivably attached to the turn piece, the interior torque blade driver having a shaped opening for drivably receiving the first end of the torque blade;

an interior printed circuit board mounted to the battery holder, the printed circuit board having a switch having a protruding actuator, and having a wiring connector, the actuator being positioned to be selectively actuated by a camming action caused by a rotation of the interior torque blade driver, the switch having a first state and a second state;

a wiring harness extending from the control circuit of the exterior actuator assembly to the wiring connector of the printed circuit board of the interior actuator assembly; and configured such that when the switch is in the first state by a rotation of the interior turn piece to unlock the deadbolt mechanism, the control logic of the control circuit of the exterior actuator assembly causes the electro-mechanical coupling mechanism of the exterior actuator assembly to attain the unlocked condition.

15. The manually driven electronic deadbolt assembly of claim 14, wherein the electro-mechanical coupling mechanism has a motor, and when the switch is in the first state the motor is electrically disengaged by the control logic of the control circuit after the electro-mechanical coupling mechanism of the exterior actuator assembly has attained the unlocked condition.

16. The manually driven electronic deadbolt assembly of claim 15, further comprising a programming button configured to allow the programming of a memory of the control circuit of the exterior actuator assembly with a plurality of unique user access codes via the code input mechanism.

17. The manually driven electronic deadbolt assembly of claim 16, wherein the control circuit of the exterior actuator assembly is configured such that when the manually driven electronic deadbolt assembly is in the locked condition and a valid input code corresponding to one of the plurality of unique user access codes is entered on the code input mechanism to attain the unlocked condition at the exterior actuator assembly, the user has a predetermined period of time in which to rotate the manually operable bezel to unlock the deadbolt mechanism, and if the manually operable bezel is not rotated to unlock the deadbolt mechanism during the predetermined period of time, at the expiration of the predetermined period of time the electro-mechanical coupling mechanism of the exterior actuator assembly is returned back to the locked condition.

18. An exterior actuator assembly configured to operate a deadbolt mechanism, comprising:

a chassis body configured to mount the exterior actuator assembly to a door;

a manually operable bezel rotatably coupled to the chassis body and configured to selectively operate the deadbolt mechanism;

a code input mechanism coupled to the chassis body, the code input mechanism being configured to receive an input code from a user;

a control circuit coupled in electrical communication with the code input mechanism, the control circuit being configured with control logic to discriminate between a valid input code and an invalid input code;

an electro-mechanical coupling mechanism mounted to the chassis body, and configured to selectively operatively couple the manually operable bezel to the deadbolt mechanism, the electro-mechanical coupling mechanism being communicatively coupled to the control circuit;

the electro-mechanical coupling mechanism being configured such that in a locked condition the manually operable bezel is drivably decoupled from the deadbolt mechanism in which the manually operable bezel is free-spinning when rotated and incapable of operating the deadbolt mechanism;

the electro-mechanical coupling mechanism being configured to drivably couple the manually operable bezel to the torque blade when the valid input code is received by the code input mechanism to facilitate an unlocked condition in which a rotation of the manually operable bezel effects operation of the deadbolt mechanism;

the chassis body defining a rotational axis, and wherein the electro-mechanical coupling mechanism comprises:

a torque blade driver rotatable around the rotational axis, the torque blade driver having a driver body having a proximal cavity, and the driver body having a first recess that extends radially outwardly from the proximal cavity into the driver body, the torque blade driver being configured to be mechanically coupled to the deadbolt mechanism via a torque blade;

a gear sleeve rotatable around the rotational axis and rotatably coupled to the manually operable bezel, the gear sleeve having a sleeve body with a distal sleeve portion configured to be rotatably received in the proximal cavity of the torque blade driver, the sleeve body having a proximal sleeve portion with a circumferential gear having external gear teeth extending outwardly from the sleeve body, the sleeve body having an internal cavity, the sleeve body having a second recess in the distal sleeve portion that extends radially inwardly from an exterior surface of the distal sleeve portion;

a coupling member configured to be radially positioned in at least one of the first recess of the torque blade driver and the second recess of the gear sleeve; and an actuator mechanism configured to selectively position the coupling member relative to the first recess of the torque blade driver and the second recess of the gear sleeve to select one of the locked condition and the unlocked condition.

19. The exterior actuator assembly of claim 18, wherein the actuator mechanism is configured to position the coupling member to drivably engage both the first recess of the torque blade driver and the second recess of the gear sleeve when the electro-mechanical coupling mechanism is in the unlocked condition to rotatably fix the gear sleeve to the torque blade driver, and configured to position the coupling member to drivably disengage from one of the first recess of the torque blade driver and the second recess of the gear sleeve when the electro-mechanical coupling mechanism is in the locked condition to rotatably decouple the gear sleeve from the torque blade driver.

20. The exterior actuator assembly of claim 19, wherein the electro-mechanical coupling mechanism is configured such that:

when the coupling member drivably engages both the first recess of the torque blade driver and the second recess of the gear sleeve, the torque blade is operable via a rotation of the manually operable bezel which in turn rotates the gear sleeve and the torque blade driver; and when the coupling member does not drivably engage both the first recess of the torque blade driver and the second recess of the gear sleeve the torque blade is not operable via a rotation of the manually operable bezel.

21. The exterior actuator assembly of claim 18, wherein the coupling member is a ball bearing made of a ferromagnetic material, and the actuator mechanism comprises:

a motor having a rotatable shaft, the motor being electrically connected to the control circuit;

a shifter positioned in the internal cavity of the gear sleeve, the shifter having a shifter body and a magnet attached to the shifter body, the shifter being configured for linear movement within the internal cavity of the gear sleeve along the rotational axis to move the magnet to define a locked position corresponding to the locked condition and an unlocked position corresponding to the unlocked condition; and a rotational-to-linear translator mechanism coupled between the rotatable shaft of the motor and the shifter, wherein a rotation of the rotatable shaft in a first rotational direction causes the magnet of the shifter to linearly translate from the locked position to the unlocked position, and a rotation of the rotatable shaft in a second rotational direction opposite of the first rotational direction causes the magnet of the shifter to linearly translate from the unlocked position to the locked position.

22. The exterior actuator assembly of claim 21, configured such that when the shifter is in the unlocked position and the first recess and the second recess are in radial alignment, the ball bearing is magnetically attracted to the magnet to cause at least one-half of the ball bearing to be received in the second recess of the gear sleeve to rotatably fix the gear sleeve to the torque blade driver in a driving arrangement.

23. The exterior actuator assembly of claim 21, wherein the shifter has a proximal portion having a first diameter and a distal portion having a second diameter less than the first diameter, and has an annular bevel that transitions between the proximal portion and the distal portion, and configured such that when the shifter translates from the unlocked position to the locked position the ball bearing rides along the annular bevel to the proximal portion to reposition the ball bearing such that less than one-half of the ball bearing is received in the second recess of the gear sleeve such that the gear sleeve is no longer rotatably fixed to the torque blade driver in a driving arrangement.

24. The exterior actuator assembly of claim 21, wherein the internal cavity of the gear sleeve is a longitudinal bore, and a portion of the shifter is axially slidably received in the longitudinal bore of the gear sleeve.

25. The exterior actuator assembly of claim 21, wherein the shifter has an axial bore having an inner circumferential portion, and the rotational-to-linear translator mechanism includes:

a drive spring mounted to the rotatable shaft of the motor for rotation with the rotatable shaft, the drive spring having a plurality of coils; and a pin that radially projects from the inner circumferential portion of shifter toward the rotational axis, with a distal portion of the pin being drivably received between the coils of the drive spring.

26. The exterior actuator assembly of claim 21, wherein the rotational-to-linear translator mechanism includes:

an axial threaded bore formed in the shifter; and a threaded drive mounted to the rotatable shaft of the motor for rotation with the rotatable shaft, the threaded drive having external threads that threadably engage the axial threaded bore of the shifter.

27. The exterior actuator assembly of claim 18, comprising:

a shifter positioned in the internal cavity of the gear sleeve, the shifter being configured for linear movement within the internal cavity of the gear sleeve along the rotational axis to define a locked position corresponding to the locked condition and an unlocked position corresponding to the unlocked condition;

a locking wedge positioned in the internal cavity of the gear sleeve, the locking wedge having a proximal portion having a first diameter and a distal portion having a second diameter greater than the first diameter, and a proximally-facing wedge surface that transitions from the proximal portion to the distal portion;

a spring configured to bias the locking wedge toward a distal end of the shifter; and a coupling member biasing assembly configured to bias the coupling member toward the locking wedge.

28. The exterior actuator assembly of claim 27, the actuator mechanism comprises:

a motor having a rotatable shaft, the motor being electrically connected to the control circuit;

a threaded drive mounted to the rotatable shaft of the motor for rotation with the rotatable shaft, the threaded drive having external threads; and the shifter having a proximal cavity configured to receive an external surface of the motor, and having an axial threaded bore having threads that threadably engage the external threads of the threaded drive, and the distal end of the shifter configured to axially engage the proximal portion of the locking wedge.

29. The exterior actuator assembly of claim 27, configured wherein:

when the shifter translates from the locked position to the unlocked position the coupling member, configured as a ball bearing, rides along a surface of the locking wedge from the proximal portion up the annular bevel to the distal portion such that the ball bearing is received in the first recess of the torque blade driver to rotatably fix the gear sleeve to the torque blade driver in a driving arrangement; and when the shifter translates from the unlocked position to the locked position the ball bearing rides along the surface of the locking wedge from the distal portion down the annular bevel to the proximal portion such that the ball bearing is received only in the second recess of the gear sleeve such that the gear sleeve is no longer rotatably fixed to the torque blade driver in the driving arrangement.

30. The exterior actuator assembly of claim 18, wherein the code input mechanism has an exterior surface and includes a pair of electrical contacts positioned on the exterior surface, the pair of electrical contacts being configured to facilitate application of external electrical power to the control circuit for operation of the exterior actuator assembly in the event of a power failure of an internal power source of the exterior actuator assembly.

31. A method for operating a deadbolt mechanism mounted on a door that separates an exterior space from a secured space, comprising:

providing a torque blade to be drivably received in a spindle drive opening of the deadbolt mechanism, the torque blade having a first end and a second end;

providing an interior actuator assembly for operating the deadbolt mechanism from the secured space, the interior actuator being mechanically connected to the first end of the torque blade; and providing an exterior actuator assembly for operating the deadbolt mechanism from the exterior space, the exterior actuator assembly having a locked condition and an unlocked condition, the exterior actuator assembly having:

a chassis body configured to mount the exterior actuator assembly to the door;

a manually operable bezel rotatably coupled to the chassis body and configured to selectively operate the deadbolt mechanism;

a code input mechanism coupled to the chassis body, the code input mechanism being configured to receive an input code from a user;

a control circuit coupled in electrical communication with the code input mechanism, the control circuit being configured with control logic to discriminate between a valid input code and an invalid input code;

an electro-mechanical coupling mechanism mounted to the chassis body, and configured to selectively couple the manually operable bezel to the torque blade, the electro-mechanical coupling mechanism being communicatively coupled to the control circuit and mechanically connected to the second end of the torque blade;

the electro-mechanical coupling mechanism being configured such that in the locked condition the manually operable bezel is drivably decoupled from the torque blade in which the manually operable bezel is free-spinning when rotated and incapable of rotating the torque blade to operate the deadbolt mechanism;

the electro-mechanical coupling mechanism being configured to drivably couple the manually operable bezel to the torque blade when the valid input code is input to the code input mechanism to facilitate the unlocked condition in which a rotation of the manually operable bezel effects a rotation of the torque blade to operate the deadbolt mechanism;

wherein the chassis body defines a rotational axis, and wherein the electro-mechanical coupling mechanism comprises:

a torque blade driver rotatable around the rotational axis, the torque blade driver having a driver body having a proximal cavity, and the driver body having a first recess that extends radially outwardly from the proximal cavity into the driver body, the torque blade driver being configured to be mechanically coupled to the deadbolt mechanism via a torque blade;

a gear sleeve rotatable around the rotational axis and rotatably coupled to the manually operable bezel, the gear sleeve having a sleeve body with a distal sleeve portion configured to be rotatably received in the proximal cavity of the torque blade driver, the sleeve body having a proximal sleeve portion with a circumferential gear having external gear teeth extending outwardly from the sleeve body, the sleeve body having an internal cavity, the sleeve body having a second recess in the distal sleeve portion that extends radially inwardly from an exterior surface of the distal sleeve portion;

a coupling member configured to be radially positioned in at least one of the first recess of the torque blade driver and the second recess of the gear sleeve; and an actuator mechanism configured to selectively position the coupling member relative to the first recess of the torque blade driver and the second recess of the gear sleeve to select one of the locked condition and the unlocked condition.

* * * * *